US012799639B2

(12) United States Patent
Yang et al.

(10) Patent No.: US 12,799,639 B2
(45) Date of Patent: Nov. 17, 2026

(54) METHOD FOR MAKING FIBRES

(71) Applicant: Imperial College Innovations Limited, London (GB)

(72) Inventors: Shirley Min Yang, London (GB); Zoyia Kamora, London (GB); Milo Shaffer, London (GB); Agnieszka Brandt-Talbot, London (GB)

(73) Assignee: IMPERIAL COLLEGE INNOVATIONS LIMITED, London (GB)

( * ) Notice: Subject to any disclaimer, the term of this patent is extended or adjusted under 35 U.S.C. 154(b) by 50 days.

(21) Appl. No.: 18/869,011

(22) PCT Filed: May 31, 2023

(86) PCT No.: PCT/EP2023/064612
§ 371 (c)(1),
(2) Date: Nov. 25, 2024

(87) PCT Pub. No.: WO2023/232905
PCT Pub. Date: Dec. 7, 2023

(65) Prior Publication Data

US 2025/0347033 A1 Nov. 13, 2025

(30) Foreign Application Priority Data

May 31, 2022 (GB) ..... 2208067

(51) Int. Cl.
*D01F 9/17* (2006.01)
*D01D 1/02* (2006.01)
(Continued)

(52) U.S. Cl.
CPC ..... *D01F 9/17* (2013.01); *D01D 1/02* (2013.01); *D01D 5/06* (2013.01); *D01D 10/02* (2013.01);
(Continued)

(58) Field of Classification Search
CPC ..... D01D 5/06; D01D 10/02; D01D 1/02; C08L 97/005; C08H 8/00; D01F 9/17;
(Continued)

(56) References Cited

U.S. PATENT DOCUMENTS 3,723,609 A 3/1973 Mansmann et al.
10,006,152 B2 6/2018 Lehmann et al.
(Continued)

FOREIGN PATENT DOCUMENTS

CN 105350114 A 2/2016
DE 102012006501 A1 10/2013
(Continued)

OTHER PUBLICATIONS

Bengtsson et al., "Improved Yield of Carbon Fibres from Cellulose and Kraft Lignin", Holzforschung, vol. 72(12), pp. 1007-1016. 2018.

(Continued)

*Primary Examiner* — Monica A Huson
(74) *Attorney, Agent, or Firm* — Heslin Rothenberg Farley & Mesiti P.C.

(57) ABSTRACT

This invention relates to a method for making fibres, the method comprising: providing a spinning dope comprising a dope solvent, lignin dissolved in the dope solvent and a carbon nanomaterial dispersed in the dope solvent, wherein the dope solvent comprises an ionic liquid and optionally further comprises water; and extruding the spinning dope into a coagulation bath to obtain one or more fibres.

19 Claims, 6 Drawing Sheets

(51) Int. Cl.

| | |
|---|---|
| ***D01D 5/06*** | (2006.01) |
| ***D01D 10/02*** | (2006.01) |
| ***D01F 1/10*** | (2006.01) |
| ***D01F 9/00*** | (2006.01) |

(52) U.S. Cl.
CPC ..... *D01F 1/10* (2013.01); *D01F 9/00* (2013.01); *D10B 2401/063* (2013.01)

(58) Field of Classification Search
CPC ..... D01F 1/10; D01F 9/00; D01F 1/02; C08K 3/041; D10B 2401/063
See application file for complete search history.

(56) References Cited

U.S. PATENT DOCUMENTS

| | | | | |
|---|---|---|---|---|
| 10,633,770 | B2 | 4/2020 | Ford et al. | |
| 10,982,010 | B2 | 4/2021 | Hallett et al. | |
| 2011/0285049 | A1 | 11/2011 | Baker et al. | |
| 2014/0363669 | A1* | 12/2014 | Otto | C01B 32/168 252/502 |
| 2016/0258082 | A1 | 9/2016 | Rios et al. | |
| 2018/0327969 | A1 | 11/2018 | Hallett et al. | |
| 2019/0153625 | A1 | 5/2019 | Michud et al. | |
| 2020/0079930 | A1 | 3/2020 | Ford et al. | |

FOREIGN PATENT DOCUMENTS

| | | | |
|---|---|---|---|
| EP | 0304010 | A2 | 2/1989 |
| GB | 1111299 | A | 4/1968 |
| WO | 2012080702 | A2 | 6/2012 |
| WO | 2014140643 | A1 | 9/2014 |
| WO | 2015143497 | A1 | 10/2015 |
| WO | 2017085516 | A1 | 5/2017 |
| WO | 2017129231 | A1 | 8/2017 |
| WO | 2018169479 | A1 | 9/2018 |
| WO | 2019086377 | A2 | 5/2019 |
| WO | 2019145299 | A1 | 8/2019 |
| WO | 2019151937 | A1 | 8/2019 |
| WO | 2021015078 | A1 | 1/2021 |

OTHER PUBLICATIONS

Bengtsson et al., "Carbon Fibers from Lignin-Cellulose Precursors: Effect of Stabilization Conditions", ACS Sustainable Chemistry & Engineering, vol. 7, pp. 8440-8448. 2019.
Bengtsson et al., "Carbon Fibers from Lignin-Cellulose Precursors: Effect of Carbonization Conditions", ACS Sustainable Chemistry & Engineering, vol. 8, pp. 6826-6833. 2020.
Brandt-Talbot et al., "An Economically Viable Ionic Liquid for the Fractionation of Lignocellulosic Biomass", Green Chemistry, vol. 19, p. 3078-3102. 2017.
Follmer et al., Wet-Spinning and Carbonization of Lignin-Polyvinyl Alcohol Precursor Fibers, Advanced Sustainable Systems, vol. 1900082, 11 pages. 2019.
Kubo et al., "The Formation of Strong Intermolecular Interactions in Immiscible Blends of Poly(vinyl alcohol) (PVA) and Lignin", Biomacromolecules, vol. 4, pp. 561-567. 2003.
Olsson et al., "Carbon Fibres from Precursors Produced by Dry-Jet Wet-Spinning of Kraft Lignin Blended with Kraft Pulps," Holzforschung, vol. 71(4), pp. 275-283. 2017.
Combined Search and Examination Report in GB Application No. 2208067.5, 6 pages. Nov. 28, 2022.
International Search Report and Written Opinion in International Application No. PCT/EP2023/064612, 12 pages. Nov. 28, 2023.
Liu et al., "Processing, Structure, and Properties of Lignin- and CNT-Incorporated Polyacrylonitrile-Based Carbon Fibers", ACS Sustainable Chemistry & Engineering, vol. 3, pp. 1943-1954. 2015.
Lu et al., "Effect of the Coagulation Bath on the Structure and Mechanical Properties of Gel-Spun Lignin/Poly(vinyl alcohol) Fibers", ACS Sustainable Chemistry & Engineering, vol. 5, pp. 2949-2959. Feb. 12, 2017.
Zhang et al., "Electrospun lignin-based composite nanofiber membrane as high-performance absorbent for water purification", International Journal of Biological Macromolecules, vol. 141, pp. 747-755. 2019.
Zhang et al., "Carbon fibers from dry-spinning of acetylated softwood kraft lignin", Carbon 69, pp. 626-629. 2014.
Weigand et al., "Effect of pretreatment severity on the cellulose and lignin isolated from Salix using ionoSolv pretreatment", Faraday Discussions, vol. 202, pp. 331-349. 2017.
Vincent et al., "Regenerated Cellulose and Willow Lignin Blends as Potential Renewable Precursors for Carbon Fibers", ACS Sustainable Chemistry & Engineering, vol. 6, pp. 5903-5910. 2018.
Verdia et al., "Fractionation of lignocellulosic biomass with the ionic liquid 1-butylimidazolium hydrogen sulfate", Green Chemistry, vol. 16, pp. 1617-1627. 2014.
Steudle et al., "Carbon Fibers Prepared from Melt Spun Peracylated Softwood Lignin: an Integrated Approach", Macromol. Mater. Eng., vol. 302, pp. 1-11. 2017.
Nair et al., "High Shear Homogenization of Lignin to Nanolignin and Thermal Stability of Nanolignin-Polyvinyl Alcohol Blends", ChemSusChem, vol. 7, pp. 3513-3520. 2014.
Malaret et al., "Eucalyptus red grandis pretreatment with protic ionic liquids: effect of severity and influence of sub/super-critical CO2 atmosphere on pretreatment performance", RSC Advances, vol. 10, pp. 16050-16060 2020.
Ma et al., "High-Strength Composite Fibers from Cellulose-Lignin Blends Regenerated from Ionic Liquid Solution", ChemSusChem, vol. 8, pp. 4030-4039. 2015.
Lu et al., "Properties and Structural Anisotropy of Gel-Spun Lignin/Poly(Vinyl Alcohol) Fibers Due to Gel Aging" ACS Sustainable Chemistry & Engineering, vol. 6, pp. 679-689. 2018.
Le et al., "Cellulose-lignin Composite Fibers as Precursors for Carbon Fibers: Part 2—The Impact of Precursor Properties on Carbon Fibers", Carbohydrate Polymers, vol. 250, pp. 1-7. 2020.
Kubo et al., "Kraft Lignin/Poly(ethylene oxide) Blends: Effect of Lignin Structure on Miscibility and Hydrogen Bonding", Journal of Applied Polymer Science, vol. 98, pp. 1437-1444. 2005.
Kubo et al., "Poly(Ethylene Oxide)/Organosolv Lignin Blends: Relationship Between Thermal Properties, Chemical Structure, and Blend Behavior", Macromolecules, vol. 37, pp. 6904-6911. 2004.
Kubo et al., "Lignin-based Carbon Fibers: Effect of Synthetic Polymer Blending on Fiber Properties", Journal of Polymers and the Environment, vol. 13, No. 2, p. 97-105. Apr. 2005.
Kleinhans et al., "Development of lignin carbon fibers: Evaluation of the carbonization process", Journal of Applied Polymer Science, pp. 1-7. 2016.
Kadla et al., "Lignin-based polymer blends: analysis of intermolecular interactions in lignin-synthetic polymer blends", Science Direct, Composites: Part A, vol. 35, pp. 395-400. 2004.
Jin et al., "Carbon Fibers Derived from Fractionated-Solvated Lignin Precursors for Enhanced Mechanical Performance", ACS Sustainable Chemistry & Engineering, vol. 6, pp. 14135-14142. 2018.
Hosseinaei et al., "Role of Physicochemical Structure of Organosolv Hardwood and Herbaceous Lignins on Carbon Fiber Performance", ACS Sustainable Chemistry & Engineering, vol. 4, pp. 5785-5798. Sep. 15, 2016.
Hosseinaei et al., "Improving Processing and Performance of Pure Lignin Carbon Fibers through Hardwood and Herbaceous Lignin Blends", International Journal of Molecular Sciences, vol. 18, No. 1410, pp. 1-13. Jul. 1, 2017.
Gschwend et al., "Pretreatment of Lignocellulosic Biomass with Low-cost Ionic Liquids", Journal of Visualized Experiments, vol. 114, pp. 1-6. Aug. 2016.
Culebras et al., "Biobased Structurally Compatible Polymer Blends Based on Lignin and Thermoplastic Elastomer Polyurethane as Carbon Fiber Precursors", ACS Sustainable Chemistry & Engineering, vol. 6, pp. 8816-8825. 2018.
Clough et al., "Thermal decomposition of carboxylate ionic liquids: trends and mechanisms", Phys. Chem. Chem. Phys., vol. 15, pp. 20480-20495. 2013.

(56) References Cited

OTHER PUBLICATIONS

Chen et al., "Inexpensive ionic liquids: [HSO4]-based solvent production at bulk scale", Green Chemistry, vol. 16, pp. 3098-3106. 2014.
Chambon et al., "Fractionation by Sequential Antisolvent Precipitation of Grass, Softwood, and Hardwood Lignins Isolated Using Low-Cost Ionic Liquids and Water", ACS Sustainable Chemistry & Engineering, vol. 8, pp. 3751-3761. 2020.
Andersson et al., "The impact of inorganic elements on lignin-based carbon fibre quality", presented at the 15th European workshop on lignocellulosics and pulp, Aveiro, Portugal, 4 pages. Jun. 2018.
Belieres et al., "Protic Ionic Liquids: Preparation, Characterization, and Proton Free Energy Level Representation", J. Phys. Chem. B, vol. 111, pp. 4926-4937. 2007.
Abouelela et al., "Evaluting the Role of Water as a Cosolvent and an Antisolvent in [HSO4]-Based Protic Ionic Liquid Pretreatment", ACS Sustainable Chemistry & Engineering, vol. 9, pp. 10524-10536. 2021.

* cited by examiner

METHOD FOR MAKING FIBRES

CROSS REFERENCE TO RELATED APPLICATIONS

This application is a U.S. National Phase filing under 35 U.S.C. § 371 of International Application PCT/EP2023/064612, filed May 31, 2023, and published as WO 2023/232905 A2 on Dec. 7, 2023. PCT/EP2023/064612 claims priority from Great Britain application number 2208067.5, filed May 31, 2022. The entire contents of each of these prior applications are hereby incorporated herein by reference.

FIELD OF THE INVENTION

This invention relates to a method for making fibres, the method comprising: providing a spinning dope comprising a dope solvent, lignin dissolved in the dope solvent and a carbon nanomaterial dispersed in the dope solvent, wherein the dope solvent comprises an ionic liquid and optionally further comprises water; and extruding the spinning dope into a coagulation bath to obtain one or more fibres.

BACKGROUND TO THE INVENTION

Carbon fibres (CFs) are strong materials that can be used to produce carbon fibre reinforced composites, which are desirable lightweight construction materials. Carbon fibres are produced by pyrolysis of precursor fibres made from polyacrylonitrile (PAN) and mesophase petroleum pitch. However, the two major precursors are derived from petroleum and are, therefore, non-renewable. For PAN, the use of toxic spinning solvents such as DMF and generation of toxic by-products such as HCN during carbonisation raises additional environmental and health concerns. The high cost associated with precursor fabrication and the energy intensive high temperature processing also limits carbon fibre composite use to high-end markets and are an obstacle to fast market growth.

Lignin has the potential to be a lower cost and renewable alternative precursor, as it is a readily available biopolymer with a high carbon content. Lignin is attractive for its sustainable origin, low cost and relatively high fibre yield after carbonisation. Over 70 million tonnes of lignin are extracted each year during paper and pulp manufacture. Commercial lignin-based carbon fibres could support the economics of the developing renewable chemical industry by providing additional revenues to wood-processing biorefineries, which currently burn most of the lignin for generating heat and electricity rather than value added products.

Most research relating to the production of lignin fibres has focused on melt spinning, at around 200 °C, often with a co-polymer. Although the process is attractive as it avoids solvents, it is difficult to control the thermal behaviour of the lignin to obtain a suitable melt behaviour and oxidative stabilisation is slow to maintain fibre shape.

Wet (coagulation) spinning of pure unmodified lignin has not been demonstrated, likely due to its low average molar weight. Wet-spinning can be enabled by blending lignin with another fibre-forming polymer, such as cellulose. Solvents reported to date for wet-spinning include DMSO (Föllmer, M. et al, Wet-Spinning and Carbonization of Lignin-Polyvinyl Alcohol Precursor Fibers. *Advanced Sustainable Systems* 2019; Lu, C. et al, *ACS Sustainable Chemistry and Engineering* 2017, 5 (4), 2949-2959).

In addition, the ionic liquid (IL) 1-ethyl-3-methylimidazolium acetate, [EMim][OAc] has been used to form precursor lignin/cellulose fibres with pure water as a coagulant (Bengtsson, A. et al, *Holzforschung* 2018, 72 (12), 1007-1016; Vincent, S. et al., *ACS Sustainable Chemistry and Engineering* 2018, 6 (5), 5903-5910). The ionic liquid 1,5-diazabicyclo[4.3.0]non-5-enium acetate [DBNH][OAc] has also been used to produce carbon fibres derived from 50/50% Kraft lignin/cellulose precursor fibres (Ma, Y. et al. *ChemSusChem* 2015, 8 (23), 4030-4039). However, these methods require expensive ILs that must be rigorously dried to dissolve cellulose, which represents a challenge for commercialisation.

Thus, there is a need for new methods for production of lignin fibres that enable the use of non-toxic, low-cost solvents. It is also desirable to produce lignin fibres with improved graphitic structure and higher carbon yield.

SUMMARY OF THE INVENTION

In a first aspect, provide herein is a method for making fibres, the method comprising: providing a spinning dope comprising a dope solvent, lignin dissolved in the dope solvent and a carbon nanomaterial, wherein the dope solvent comprises an ionic liquid and, optionally, water; and extruding the spinning dope into a coagulation bath to obtain one or more fibres.

In a second aspect, provided herein is a fibre obtainable by the method of the first aspect.

In a third aspect, provided herein is a spinning dope comprising, a dope solvent, lignin and a carbon nanomaterial, wherein the dope solvent comprises an ionic liquid and optionally water. The spinning dope may be as described in relation to the first aspect.

In a fourth aspect, provided herein is a dispersion comprising carbon nanotubes and [DMBA][$HSO_4$].

BRIEF DESCRIPTION OF FIGURES

Embodiments of the disclosure will now be described, by way of example only, and with reference to the drawings in which.

DETAILED DESCRIPTION

Figure 1:
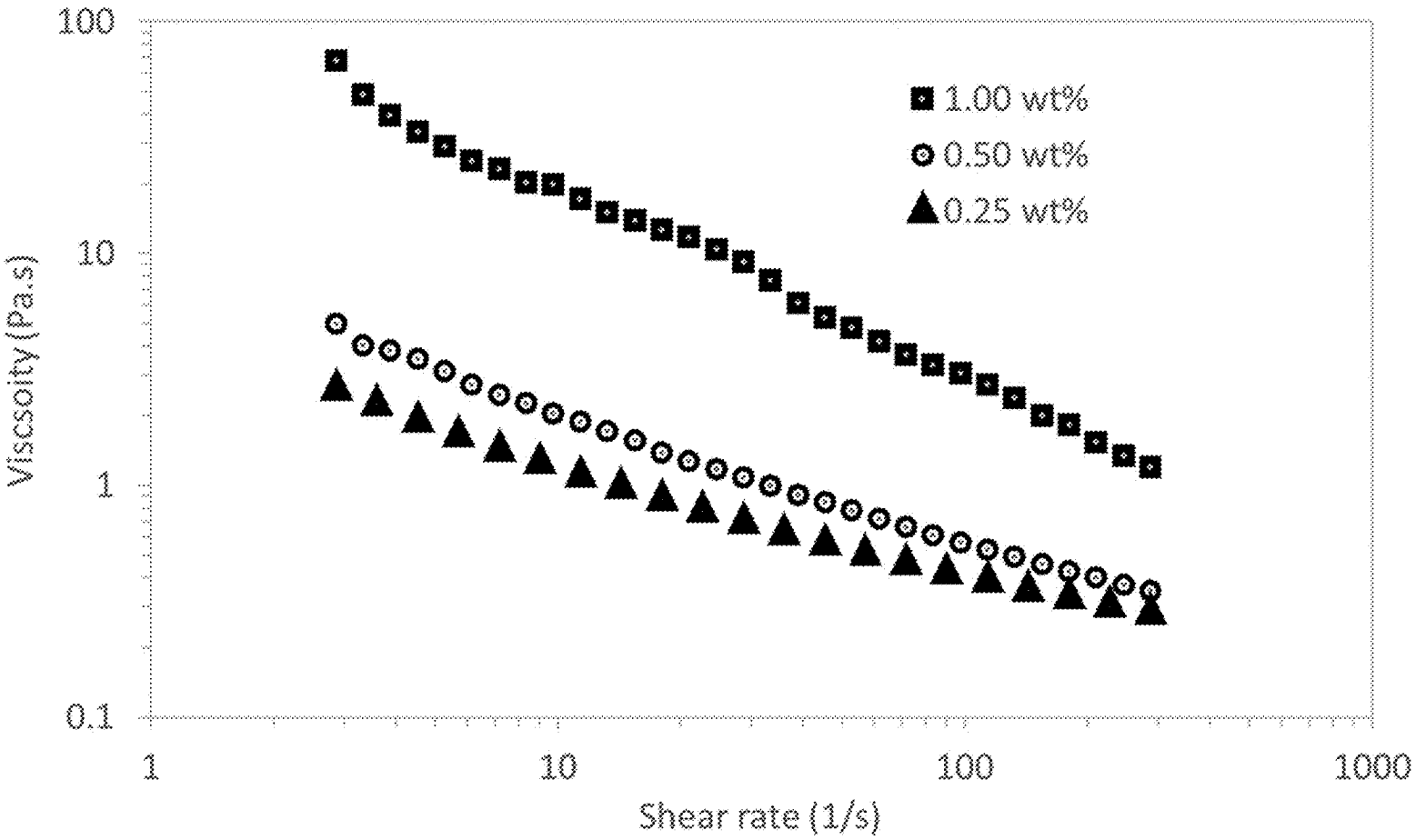
FIG. 1 shows a shear rate sweep for fibres produced as described herein.

In a first aspect, provided herein is a method for making fibres, the method comprising: providing a spinning dope comprising a dope solvent, lignin dissolved in the dope solvent and a carbon nanomaterial, wherein the dope solvent comprises an ionic liquid and, optionally, water; and extruding the spinning dope into a coagulation bath to obtain one or more fibres.

The fibres produced by this method may be referred to as lignin fibres. The fibres comprise lignin and carbon nanomaterial. The fibres may be used, for example, as precursor fibres for the production of carbon fibres or as a raw material for other fibre-based materials.

The dope solvent is a solvent within which lignin may be dissolved. Preferably, the dope solvent is a solvent within which cellulose has lower solubility than lignin. More preferably, the dope solvent does not dissolve cellulose.

The spinning dope preferably comprises a cellulose loading of no more than 10%, relative to the mass of the spinning dope, excluding the mass of cellulose, lignin and carbon nanomaterial (i.e. w/w %). Preferably, the cellulose loading is no more than 5%, no more than 2% or no more than 1%. The spinning dope is preferably substantially free of cellulose. Undissolved cellulose may be removed for example by filtration.

The dope solvent may have a water content of 0-30 wt %, 0-20 wt %, 0-15 wt %, 0-10 wt % or 0-5 wt %. The dope solvent may have a water content of at least 1 wt %, at least 2 wt % or at least 3 wt %. The water content of the dope solvent is calculated based on the mass of water present relative to the total mass of the dope solvent (i.e., w/w %). The dope solvent may further comprise ethanol. The dope solvent may comprise 0-20 wt % ethanol, for example 1-20 wt % ethanol, preferably 5-15 wt % ethanol, calculated relative to the total mass of the dope solvent (i.e. w/w %).

Where the dope solvent comprises ethanol, the ionic liquid:ethanol mass ratio may be from 3:1 to 15:1, preferably from 5:1 to 12:1.

Lignin may be present in the spinning dope at a loading of at least 5 wt %, preferably at least 10 wt %, relative to the mass of the spinning dope, excluding the mass of lignin and carbon nanomaterial. Lignin may preferably be present at a loading of 10-50 wt %, 10-40 wt %, 10-30 wt %, relative to the mass of the spinning dope, excluding the mass of lignin and carbon nanomaterial. The lignin may be, for example, hardwood lignin, softwood lignin, grass lignin or other lignin (e.g. a genetically modified lignin). The lignin may be a hardwood lignin. The lignin may be ionoSolv lignin or kraft lignin, such as LignoBoost lignin.

Carbon nanomaterial may be present in the spinning dope at a loading of at least 0.001 wt %, at least 0.01 wt %, or at least 0.1 wt %, relative to the mass of the spinning dope, excluding the mass of lignin and carbon nanomaterial. The carbon nanomaterial may be present at a loading of 0.001-10 wt %, 0.001-8 wt %, 0.01-8 wt %, 0.1-5 wt %, 0.1-1 wt % or 0.3-0.7 wt %, relative to the mass of the spinning dope, excluding the mass of lignin and carbon nanomaterial. The carbon nanomaterial may be present at a loading of about 0.5%, relative to the mass of the spinning dope, excluding the mass of lignin and carbon nanomaterial.

The weight ratio of lignin to carbon nanomaterial in the spinning dope may be from 5:1 to 10000:1, preferably from 5:1 to 5000:1, more preferably from 10:1 to 1000:1, even more preferably from 20:1 to 200:1.

The spinning dope may have a water content of 0-30 wt %, 0-20 wt %, 0-15 wt %, 0-10 wt % or 0-5 wt %. The dope solvent may have a water content of at least 1 wt %, at least 2 wt % or at least 3 wt %, calculated based on the mass of water present relative to the mass of the spinning dope, excluding the mass of lignin and carbon nanomaterial.

The carbon nanomaterial may comprise carbon nanotubes, carbon nanoribbons, graphene nanoplates or a combination thereof. Preferably, the carbon nanomaterial comprises carbon nanotubes. Preferably, the carbon nanotubes are single-walled carbon nanotubes (SWCNTs).

The carbon nanomaterial may be dispersed in the dope solvent.

The ionic liquid may be any ionic liquid as described herein. Preferably, the ionic liquid comprises a cation and an anion selected from $C_{1-20}$ alkyl sulfate ($[AlkylSO_4]^-$), $C_{1-20}$ alkylsulfonate ($[AlkylSO_3]^-$), hydrogen sulfate ($[HSO_4]^-$), hydrogen sulfite ($[HSO_3]^-$), dihydrogen phosphate ($[H_2PO_4]^-$), hydrogen phosphate ($[HPO_4]^{2-}$), chloride ($Cl^-$), bromide ($Br^-$), trifluoromethanesulfonate ($[OTf]^-$), formate ($[HCOO]^-$) and acetate ($[MeCO_2]^-$). Preferably, the anion is selected from $[HSO_4]^-$ and $[HCOO]^-$.

The cation may be an aprotic cation or a protic cation, preferably a protic cation. The cation may contain a nitrogen-containing heterocyclic moiety or be a cation of Formula I

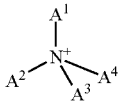

wherein $A^1$ to $A^4$ are each independently selected from H, an aliphatic, $C_{3-6}$ carbocycle, $C_{6-10}$ aryl, alkylaryl, and heteroaryl.

The ionic liquid may be an [alkylammonium][$HSO_4$] or [alkylammonium][HCOO] ionic liquid.

The ionic liquid may be N,N-dimethylbutylammonium hydrogen sulfate ([DMBA][$HSO_4$]), 1-butylimidazolium hydrogen sulfate ([HBim][$HSO_4$]), triethylammonium hydrogen sulfate ([TEA][$HSO_4$]), N-methylbutylammonium hydrogen sulfate ([MBA][$HSO_4$]), 1-methylimidazolium formate ([HMim][HCOO]), N,N-dimethylbutylammonium formate ([DMBA][HCOO]), or a mixture thereof. Preferably, the ionic liquid is [DMBA][$HSO_4$].

The ionic liquid may be [DMBA][$HSO_4$]. [DMBA][$HSO_4$] has shown particular aptitude in the extraction of lignin from lignocellulosic biomass fractionation while having a lower melting point (and hence viscosity) than other ionic liquids containing the hydrogen sulfate anion and a projected production cost of around $1/kg (similar to [TEA][$HSO_4$]), making it cheaper than most ionic liquids and also DMSO. Moreover, ammonium-based hydrogen sulfate Ils may be recyclable.

In the method described herein, fibres are formed using wet (coagulation) spinning. This involves extruding a spinning dope into a coagulant to form fibres. The coagulant may be contained in a coagulation bath. The coagulant may comprise water, preferably deionised (DI) water. The coagulant may consist essentially of water. As an alternative, the coagulant may comprise water and an ionic liquid. The ionic liquid may be any ionic liquid as described herein and, preferably, the same ionic liquid as present in the dope solvent. The ionic liquid may be present within the coagulant at no more than 60 wt %, no more than 30 wt %, or no more than 15 wt %, preferably 1-60 wt %, 1-30 wt % or 1-15 wt %, more preferably 5-10 wt % (based on total mass of coagulant). In a further alternative, the coagulant comprises water and sodium sulfate ($Na_2SO_4$). For example, the coagulation bath may comprise aqueous sodium sulfate at a concentration of 0.5-1.5M, preferably about 1M.

The fibres may be extruded using any suitable wet-spinning process, for example using a continuous spinning line. The fibres may be extruded into a rotational bath.

The spinning dope may be prepared by a process comprising:

a) dissolving lignin in the dope solvent to obtain a lignin solution;

b) combining the lignin solution with the carbon nanomaterial; and c) dispersing the carbon nanomaterial in the dope solvent to obtain the spinning dope.

Dispersing may be carried out by shearing. Shearing may be carried out to obtain dispersion of the carbon nanomaterial, for example, using a pestle and mortar, a shear mixer such as a Banbury mixer, a two roll mill, a three roll mill, a centrifugal mixer, a bead mill, a Silverson mixer, or a jet mill.

Dissolution of the lignin may performed at a temperature of 10 °C to 200 °C, preferably 10 °C to 100 °C, more preferably 20 °C to 100 °C, 20 °C to 60 °C, or 20 °C to 30 °C.

The spinning dope may be prepared by a process comprising preparing a lignin solution and combining the lignin solution with the carbon nanomaterial. The lignin solution may be aged prior to combining with the carbon nanomaterial. As referenced herein, "aging" of the lignin solution refers to a period of time after the lignin solution has been prepared before combining with the carbon nanomaterial. During aging, the lignin solution may remain at room temperature or may be heated, for example, at a temperature of at least 30 °C, at least 60 °C, e.g. up to 150 °C. Aging may occur for at least 2 minutes, at least 5 minutes, at least 30 minutes, at least 1 hour, at least 1 day, at least 5 days, or at least 10 days. The lignin solution may be prepared by: (a) contacting a lignocellulosic biomass comprising lignin and cellulose with a composition comprising an ionic liquid and optionally water to dissolve the lignin and produce a cellulose pulp; (b) separating the cellulose pulp to obtain a liquor comprising the ionic liquid, water and lignin; and (c) optionally adjusting the amount of ionic liquid and/or water in the liquor to obtain the lignin solution. The ionic liquid is the same ionic liquid as present within the dope solvent. The liquor produced in step b) may be concentrated prior to step c). Preparing the spinning dope may comprise shearing to obtain the spinning dope after combining the lignin solution with the carbon nanomaterial. Shearing may be carried out to obtain dispersion of the carbon nanomaterial, for example, using a pestle and mortar, a shear mixer such as a Banbury mixer, a two roll mill, a three roll mill, a centrifugal mixer, a bead mill, a Silverson mixer, or a jet mill.

The composition comprising the ionic liquid and water (also referred to as the ionic liquid/water composition) referenced in step (a) may comprise a 2-40 wt % water content, such as a 5-40 wt % water content, preferably a 5-10 wt % water content. The water content referenced in step (a) is calculated based on the mass of water present relative to the total mass of the ionic liquid/water composition. The ionic liquid/water composition may consist essentially of ionic liquid and water. The biomass loading in step (a) may be, for example, 10-50% or 20-50%, such as 30-40%, relative to the mass of the ionic liquid/water composition. Steps (a)-(c) make lignin extraction, formation of the spinning dope, and fibre formation possible without requiring separate steps of isolating and/or drying lignin. This may be referred to as an integrated spinning process. This approach has the potential to lower the cost of precursor fibre production by avoiding lignin precipitation, drying and redissolution steps.

The lignocellulosic biomass contacted with the composition in step a) may be heated to a temperature of at least 70 °C, preferably 100-180 °C, more preferably 120-170 °C. For example, the lignocellulosic biomass contacted with the composition may be heated to 120-150 °C. Heating may be carried out for 1 minute to 22 hours, 10 minutes to 20 hours, 10 minutes to 10 hours, 15 minutes to 8 hours or 30 minutes to 8 hours.

The biomass may be contacted with the composition and subjected to mechanical treatment, such as stirring or vortexing, to aid dissolution of the lignin and production of a cellulose pulp. Mechanical treatment may be carried out prior to heating. Ethanol may be added to the mixture resulting from step a) prior to separation of the cellulose pulp. Separation of the cellulose pulp may be carried out using filtration, for example vacuum filtration. The biomass may undergo mechanical processing before being contacted with the composition.

The integrated spinning process results in dissolution of lignin from lignocellulosic biomass in the dope solvent, but avoids dissolution of cellulose. Other components of the lignocellulosic biomass, such as hemicellulose, may dissolve.

The spinning dope may comprise additional solutes, wherein the additional solutes may be lignocellulosic biomass components such as hemicellulose, or hemicellulose degradation products, such as furfural.

The method may further comprise drying the one or more fibres under mechanical tension.

The method may further comprise heating the one or more fibres in air at 150-300 °C. This step may be performed to thermally stabilise the one or more fibres.

The method may further comprise carbonising the one or more fibres to obtain carbon fibres. The carbonising may comprise heating the one or more fibres to 800-3000 °C, preferably 1200-1800 °C, under an inert atmosphere. For example, the carbonising may be performed under nitrogen or argon, preferably nitrogen. Carbonising may be carried out with the fibres under tension.

The spinning dope may have a viscosity of 0.3-300,000, for example 0.3-100,000 or 0.3-2500 Pa·s, at zero shear (when measured at the spinning temperature). The zero-shear rate viscosity can be measured using an AR 2000ex rheometer with a cone-and-plate feature (2° cone angle, 20 mm plate diameter and 53 μm gap) at low shear rates from $3.00\times10^{-6}$ to 30 $s^{-1}$ at the spinning temperature. The spinning temperature as referenced herein may refer to 25 °C.

In a second aspect, provided herein is a fibre obtainable by the method of the first aspect.

In a third aspect, provided herein is a spinning dope comprising a dope solvent, lignin and a carbon nanomaterial, wherein the dope solvent comprises an ionic liquid and optionally water. The spinning dope may be as described in relation to the first aspect.

In a fourth aspect, provided herein is a dispersion comprising carbon nanotubes and [DMBA][$HSO_4$]. The dispersion may be a dispersion of carbon nanotubes in any dope solvent as described herein, wherein the ionic liquid is [DMBA][$HSO_4$]. Accordingly, the dope solvent may comprise water and, optionally ethanol, at any concentration as described herein. Carbon nanotubes may be present at a loading of at least 0.001 wt %, at least 0.01 wt %, or at least 0.1 wt %. The carbon nanotubes may be present at a loading of 0.001-10 wt %, 0.001-8 wt %, 0.01-8 wt %, 0.1-5 wt %, 0.1-1 wt % or 0.3-0.7 wt %. The carbon nanomaterial may be present at a loading of about 0.5 wt %. The carbon nanotubes may be single walled carbon nanotubes.

Ionic Liquids

The ionic liquid referenced herein may, for example, be an ionic liquid as described in WO2012080702, WO2014140643 or WO2017085516, which are incorporated herein by reference.

As used herein "ionic liquid" refers to an ionized species (i.e. cations and anions). Ionic liquids typically have a melting point below about 100 °C. Any of the anions listed below can be used in combination with any of the cations listed below, to produce an ionic liquid for use in the invention.

The ionic liquid may contain one of the listed anions, or a mixture thereof.

The anion may be selected from $C_{1-20}$ alkyl sulfate ($[AlkylSO_4]^-$), $C_{1-20}$ alkylsulfonate ($[AlkylSO_3]^-$), hydrogen sulfate ($[HSO_4]^-$), hydrogen sulfite ($[HSO_3]^-$), dihydrogen phosphate ($[H_2PO_4]^-$), hydrogen phosphate ($[HPO_4]^{2-}$), chloride ($Cl^-$), bromide ($Br^-$), trifluoromethanesulfonate ($[Otf]^-$), formate ($[HCOO]^-$) and acetate ($[MeCO_2]^-$). For example, the anion may be selected from $[MeSO_4]^-$, $[HSO_4]^-$, $[MeSO_3]^-$, $Cl^-$, $[HCOO]^-$ and $[MeCO_2]^-$, such as from chloride $Cl^-$ and hydrogen sulfate $[HSO_4]^-$, or from $[MeSO_4]^-$, $[HSO_4]^-$, $[MeSO_3]^-$, and $[MeCO_2]^-$. Preferably the anion is selected from $[HSO_4]^-$ and $[HCOO]^-$. The ionic liquid may contain one of the listed anions, or a mixture thereof. The ionic liquid may contain any one of the cations identified herein, or a mixture thereof.

The cation is preferably a protic cation ion i.e. The cation is capable of donating a proton ($H^+$).

The cation may be an ammonium or phosphonium derivative. These cations have the general formula

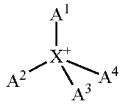

wherein

X is N or P; and $A^1$ to $A^4$ are each independently selected from H, an aliphatic, $C_{3-6}$ carbocycle, $C_{6-10}$ aryl, alkylaryl, and heteroaryl. The aliphatic may optionally be substituted with one or more —OH.

In an embodiment, the cation is an ammonium ion, a derivative thereof or a mixture thereof. The cation may be of the formula

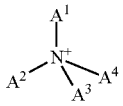

wherein $A^1$ to $A^4$ are each independently selected from H, an aliphatic, $C_{3-6}$ carbocycle, $C_{6-10}$ aryl, alkylaryl, and heteroaryl, wherein aliphatic may optionally be substituted with one or more —OH. Preferably at least one of $A^1$ to $A^4$ is H. Preferably $A^1$ to $A^4$ are each independently selected from H, and an aliphatic. In one embodiment one of $A^1$ to $A^4$ is H, and the remaining three are each independently an aliphatic. Alternatively, two of $A^1$ to $A^4$ are each H and the remaining two are each independently an aliphatic. Alternatively, one of $A^1$ to $A^4$ is an aliphatic, and the remaining three are all H. Preferably the cation is not ammonium ($NH_4^+$), i.e. at least one of $A^1$ to $A^4$ is not H. Aliphatic may be alkyl, optionally substituted with one or more —OH, preferably $C_{1-6}$ alkyl. In some embodiments, the aliphatic is unsubstituted.

In an embodiment, the cation is an alkylammonium or a mixture thereof (i.e. a cation of the formula above wherein $A^1$ to $A^4$ are each independently selected from H or alkyl, wherein at least one of $A^1$ to $A^4$ is not H). Preferably this is a protic alkylammonium, although aprotic alkylammoniums may also be used. Optionally one or more of the alkyl groups may be substituted with —OH to form an alkanolammonium, which can also be referred to as an alcoholammonium. For example, the cation may be choline. As used herein an "alkylammonium" includes trialkylammoniums, dialkylammoniums, monoalkylammoniums, and alcoholammoniums including trialcoholammoniums, dialcoholammoniums and monoalcoholammonium. Trialkylammoniums include trimethylammonium, triethylammonium, and triethanolammonium. Examples of dialkylammoniums include diethylammonium, diisopropylammonium, and diethanolammonium. Monoalkylammoniums include methylammonium, ethylammonium, and monoethanolammonium. The ionic liquid may preferably be an [alkylammonium][$HSO_4$] or an [alkylammonium][HCOO] ionic liquid.

In an embodiment, the alkylammonium cation is selected from triethylammonium, diethylammonium dimethylethylammonium, diethylmethylammonium, dimethylbutylammonium, diethanolammonium and choline. The alkylammonium cation may be selected from triethylammonium, diethylammonium dimethylethylammonium, diethylmethylammonium, and dimethylbutylammonium, diethanolammonium. In another embodiment, the alkylammonium cation is selected from dimethylbutylammonium, triethylammonium and methylbutylammonium.

The cation can also contain a nitrogen-containing heterocyclic moiety which, as used herein, refers to mono- or bicyclic ring systems which include one nitrogen atom and optionally one or more further heteroatoms selected from N, S and O. The ring systems contain 5-9 members, preferably 5 or 6 members for monocyclic groups, and 9 or 10 members for bicyclic groups. The rings can be aromatic, partially saturated or saturated and thus, include both a "heteroalicyclic" group, which means a non-aromatic heterocycle and a "heteroaryl" group, which means an aromatic heterocycle. The cation may be selected from

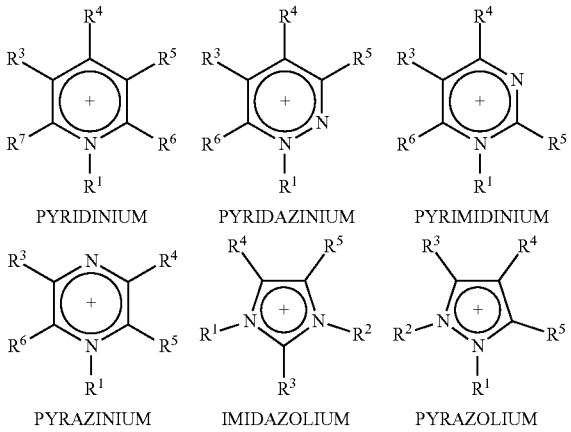

-continued

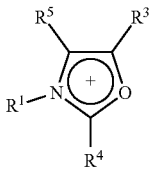

OXAZOLIUM

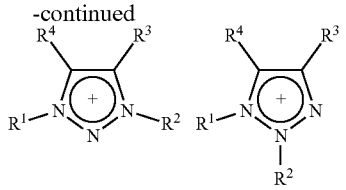

1,2,3-TRIAZOLIUM

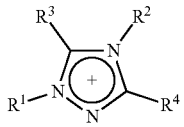

1,2,4-TRIAZOLIUM

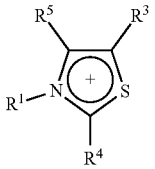

THIAZOLIUM

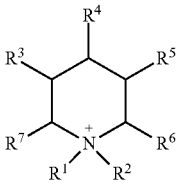

PIPERIDINIUM

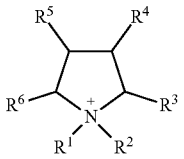

PYRROLDINIUM

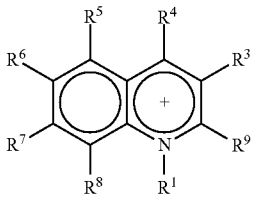

QUINOLIUM

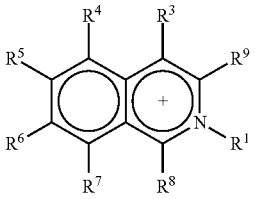

ISOQUINOLIUM wherein $R^1$ and $R^2$ are independently a $C_{1-6}$ alkyl or a $C_{1-6}$ alkoxyalkyl group, and $R^3$, $R^4$, $R^5$, $R^6$, $R^7$, $R^8$ and $R^9$, when present are independently H, a $C_{1-6}$ alkyl, $C_{1-6}$ alkoxyalkyl group, or $C_{2-6}$ alkyoxy group. Preferably $R^1$ and $R^2$ are $C_{1-4}$ alkyl, with one being methyl and $R^3$-$R^9$, ($R^3$, $R^4$, $R^5$, $R^6$, $R^7$, $R^8$ and $R^9$), when present, are H. In an embodiment, the cation ring is imidazolium or pyridinium.

In an embodiment, the cation may be an imidazolium based cation or a mixture thereof, in particular protic imidazolium based cations. In an embodiment, the imidazolium based cation may be selected from 1-butyl-3-methylimidazolium $[BMim]^+$, 1-ethyl-3-methylimidazolium $[EMim]^+$, 1-methylimidazolium $[HMim]^+$, 1-butylimidazolium $[HBim]^+$ and mixtures thereof. For example, the imidazolium based cation may be selected from 1-butyl-3-methylimidazolium $[BMim]^+$, 1-methylimidazolium $[HMim]^+$, 1-butylimidazolium $[HBim]^+$ and mixtures thereof, such as 1-methylimidazolium $[HMim]^+$, 1-butylimidazolium $[HBim]^+$ and mixtures thereof. In an embodiment, the imidazolium based cation is selected from 1-butyl-3-methylimidazolium $[BMim]^+$, 1-butylimidazolium $[HBim]^+$ and mixtures thereof.

In some embodiments, the cations include protic alkylammonium, protic methylimidazolium, protic pyridinium, aprotic tetraalkylammonium and aprotic dialkylimidazolium ions.

The ionic liquid may preferably be N,N-dimethylbutylammonium hydrogen sulfate ($[DMBA][HSO_4]$), 1-butylimidazolium hydrogen sulfate ($[HBim][HSO_4]$), triethylammonium hydrogen sulfate ($[TEA][HSO_4]$), N-methylbutylammonium hydrogen sulfate ($[MBA][HSO_4]$), 1-methylimidazolium formate ([HMim][HCOO]), N,N-dimethylbutylammonium formate ([DMBA][HCOO]), or a mixture thereof.

In an embodiment, the ionic liquid is not 1-ethyl-3-methylimidazolium acetate [EMim][OAc], In another embodiment, the ionic liquid is selected from triethylammonium hydrogen sulfate $[TEA][HSO_4]$, N,N-dimethylbutylammonium hydrogen sulfate $[DMBA][HSO_4]$, diethylammonium hydrogen sulfate $[DEA][HSO_4]$, N,N-dimethylethylammonium hydrogen sulfate ($[DMEA][HSO_4]$), diethanolammonium chloride [DEtOHA]Cl, 1-methylimidazolium hydrogen chloride [HMim]Cl, 1-ethyl-3-methylimidazolium chloride [EMim]Cl, and 1-ethyl-3-methylimidazolium trifluoromethanesulfonate [EMim][OTf].

In another embodiment, the ionic liquid is selected from 1-butyl-3-methylimidazolium methyl sulfate $[BMim][MeSO_4]$, 1-butyl-3-methylimidazolium hydrogen sulfate $[BMim][HSO_4]$, 1-butyl-3-methylimidazolium methanesulfonate $[BMim][MeSO_3]$, 1-butylimidazolium hydrogen sulfate $[HBim][HSO_4]$, and 1-ethyl-3-methylimidazolium acetate $[EMim][MeCO_2]$.

Preferred ionic liquids are $[alkylammonium][HSO_4]$ ionic liquids, for example N,N-dimethylbutylammonium hydrogen sulfate ($[DMBA][HSO_4]$), triethylammonium hydrogen sulfate ($[TEA][HSO_4]$), N-methylbutylammonium hydrogen sulfate ($[MBA][HSO_4]$), diethylammonium hydrogen sulfate $[DEA][HSO_4]$, N,N-dimethylethylammonium hydrogen sulfate ($[DMEA][HSO_4]$), and ethylammonium hydrogen sulfate $[EthylNH_3][HSO_4]$.

The dope solvent referenced herein comprises ionic liquid and optionally water. For use in the method disclosed herein, an ionic liquid is provided such that the dope solvent is capable of dissolving lignin. Preferably, cellulose has lower solubility than lignin in the dope solvent. More preferably, the dope solvent does not dissolve cellulose.

The ionic liquid, optionally in a mixture with water, may be used in the treatment of lignocellulosic biomass, for example to separate lignin and cellulose in preparation of the spinning dope in an integrated spinning process. The ionic liquid may dissolve the lignin within the biomass but not the cellulose, so that the treatment yields a cellulose pulp and lignin solution. Thus, the majority of the cellulose remains solid, for example at least 70%, preferably at least 80% (wt % relative to oven dried weight of biomass). The cellulose pulp can be easily removed from the lignin solution mechanically, for example by filtration. Other components such as hemicellulose may also dissolve in the ionic liquid.

When the ionic liquid is present in a mixture with water, this may be expressed as $[\text{ionic liquid}]_{x\ \%}/\text{water}_{y\ \%}$, wherein the percentage is the mass of the component relative to the total mass of the mixture (i.e. w/w %). For example, $[DMBA][HSO_4]_{95\%}/\text{water}_{5\%}$ refers to a mixture of $[DMBA][HSO_4]$ and water, wherein the $[DMBA][HSO_4]$ is present at 95% (w/w) (95 wt %) and the water is present at 5% (w/w) (5 wt %).

Ionic liquids can be prepared by methods known to the person skilled in the art or obtained commercially. For example, protic ammonium-based Ils can be made from a simple alkylamine, such as triethylamine, and sulfuric acid in a one-step synthesis, for example as described in George et al., (2015) "Design of low-cost ionic liquids for lignocellulosic biomass treatment" Green Chemistry 17:1728-173.

Usually in an ionic liquid the cation and anion are present in equimolar amounts. However, the ionic liquid may comprise excess base, preferably protonated base. 'Base' as used herein refers to the base from which the cation is derived e.g. amine/imidazole. The ionic liquid may comprise 10% molar excess base, for example, 4-8%, 5-7.5% excess base. The ionic liquid may comprise 2%, 3%, 4%, 5%, 6%, 7%, 8% 9% or 10% molar excess base.

In another embodiment, the dope solvent further comprises 0.01-20% molar excess acid, preferably 1-5% molar excess acid, as a percentage of the IL. The acid can be selected from any known strong acid such as hydrochloric acid, sulfuric acid, nitric acid, phosphoric acid hydroiodic acid, perchloric acid and hydrobromic acid. Preferably the acid is sulfuric or, hydrochloric or phosphoric acid. More preferably, the acid is the same acid as used to synthesis a protic IL.

It should be appreciated that the features described throughout this disclosure may be present in any combination mutatis mutandis. For examples, wherever discussion of the components or component loadings of the spinning dope is provided, these components can be present in any combination and the loadings may be present in any combination.

All publications, published patent documents, and patent applications cited herein are hereby incorporated by reference to the same extent as though each individual publication, published patent document, or patent application was specifically and individually indicated as being incorporated by reference.

DEFINITIONS

In order for the present invention to be more readily understood, certain terms are first defined below. Additional definitions for the following terms and other terms are set forth throughout the specification.

As used herein, singular forms "a," "an" and "the" also include plural forms unless the context clearly dictates otherwise. Use of the singular includes the plural unless specifically stated otherwise. As used herein, wherever "comprising" is referenced, this may also refer to "consisting essentially of" and "consisting of". For example, a dope solvent comprising ionic liquid, water and optionally ethanol, may also be a dope solvent consisting essentially of ionic liquid, water and optionally ethanol.

A "dope solvent" as referenced herein is a solvent within which lignin may be dissolved. The dope solvent may comprise a mixture of solvents. The dope solvent comprises an ionic liquid and optionally water. It may comprise additional solvents, such as ethanol. All solvent present within the spinning dope may constitute the dope solvent (i.e. the spinning dope does not contain any solvent other than the dope solvent). The dope solvent may consist essentially of ionic liquid, water and optionally ethanol. Preferably, the dope solvent does not dissolve cellulose.

Various components are described as being present in the spinning dope at a percentage loading. The loading is a mass loading, that may be referred to as a % loading or a wt % loading. In general terms, the loading is described as being relative to the mass of the spinning dope, excluding the mass of lignin and carbon nanomaterial. The loading calculation for a spinning dope component (i.e. lignin or carbon nanomaterial) is:

$$(\text{mass of component}/\text{mass of spinning dope excluding mass of lignin and carbon nanomaterial}) \times 100$$

In embodiments where the spinning dope consists essentially of dope solvent (water, ionic liquid and optionally ethanol), lignin and carbon nanomaterial, the loading calculation is:

$$(\text{mass of component}/\text{dope solvent}) \times 100$$

As described herein, in some embodiments, the spinning dope may comprise additional solutes. In such embodiments, the loading calculation is:

$$(\text{mass of component}/\text{dope solvent} + \text{additional solutes}) \times 100$$

As used herein, a "coagulant" is a liquid into which a spinning dope can be extruded. Extrusion of the spinning dope into the coagulant results in fibre formation.

A nanomaterial may be defined as a material possessing at least one external dimension of 100 nm or less. Carbon nanomaterials include, but are not limited to, carbon nanotubes, graphene nanoribbons, graphene nanoplatelets and graphene nanoflakes. Carbon nanotubes may be single walled carbon nanotubes or multiwalled carbon nanotubes. The use of carbon nanomaterials in the fibre productions methods described herein may provide improved rheology for spinning, improved precursor fibre strength for handling, improved graphitic microstructure after conversion (potentially lower temperature conversion), and direct reinforcement of final carbon fibres.

As used herein the term "lignocellulosic biomass" refers to living or dead biological material and can comprise any cellulosic or lignocellulosic material including materials comprising cellulose, and optionally further comprising hemicellulose, lignin, starch, oligosaccharides and/or monosaccharides, biopolymers, natural derivatives of biopolymers, their mixtures, and breakdown products. It can also comprise additional components, such as protein and/or lipid. The biomass can be derived from a single source, or it can comprise a mixture derived from more than one source. Some specific examples of biomass include, but are not limited to, bioenergy crops, agricultural residues, municipal solid waste, industrial solid waste, sludge from paper manufacture, yard waste, wood and forestry waste. Additional examples of biomass include, but are not limited to, corn grain, corn cobs, crop residues such as corn husks, corn stover, grasses including *Miscanthus* X *giganteus*, wheat, wheat straw, hay, rice straw, switchgrass, waste paper, sugar cane bagasse, sorghum, soy, components obtained from milling of grains, trees (e.g. pine), branches, roots, leaves, wood chips, wood pulp, sawdust, shrubs and bushes, vegetables, fruits, flowers, animal manure, multi-component feed, and crustacean biomass (i.e., chitinous biomass). It may be preferable to treat the biomass before use in the method of the invention. For example the biomass could be mechanically treated e.g. milling or shredding.

As referenced herein, "aging" of the spinning dope refers to a period of time after the spinning dope has been prepared before the dope is extruded. During aging, the dope may remain at room temperature or may be heated. During aging, the dope may undergo mixing. Aging may occur for at least 5 minutes, at least 30 minutes, for example, up to 72 or 48 hours.

Room temperature as referenced herein may refer to 25 °C.

The term "aliphatic" as used herein refers to a straight or branched chain hydrocarbon which is completely saturated or contains one or more units of unsaturation. Thus, aliphatic may be alkyl, alkenyl or alkynyl, preferably having 1 to 12 carbon atoms, preferably up to 6 carbon atoms or more preferably up to 4 carbon atoms. The aliphatic can have 1, 2, 3, 4, 5, 6, 7, 8, 9, 10, 11, or 12 carbon atoms.

The term "alkyl" as used herein, is typically a linear or branched alkyl group or moiety containing from 1 to 20 carbon atoms, such as 11, 12, 13, 14, 15, 16, 17, 18, or 19 carbon atoms. Preferably the alkyl group or moiety contains 1-10 carbon atoms i.e. 2, 3, 4, 5, 6, 7, 8, 9, or 10 carbon atoms such as a $C_{1-4}$ alkyl or a $C_{1-6}$ alkyl group or moiety, for example methyl, ethyl, n-propyl, i-propyl, n-butyl, i-butyl and t-butyl, n-pentyl, methylbutyl, dimethylpropyl, n-hexyl, 2-methylpentyl, 3-methylpentyl, 2,3-dimethylbutyl, and 2,2-dimethylbutyl.

The term "carbocycle" as used herein refers to a saturated or partially unsaturated cyclic group having 3 to 6 ring carbon atoms, i.e. 3, 4, 5, or 6 carbon atoms. A carbocycle is preferably a "cycloalkyl", which as used herein refers to a fully saturated hydrocarbon cyclic group. Preferably, a cycloalkyl group is a $C_3$-$C_6$ cycloalkyl group.

The term "$C_{6-10}$ aryl group" used herein means an aryl group constituted by 6, 7, 8, 9 or 10 carbon atoms and includes condensed ring groups such as monocyclic ring group, or bicyclic ring group and the like. Specifically, examples of "$C_{6-10}$ aryl group" include phenyl group, indenyl group, naphthyl group or azulenyl group and the like. It should be noted that condensed rings such as indan and tetrahydro naphthalene are also included in the aryl group.

The terms "alkylaryl" as used herein refers to an alkyl group as defined below substituted with an aryl as defined above. The alkyl component of an "alkylaryl" group may be substituted with any one or more of the substituents listed above for an aliphatic group and the aryl or heteroaryl component of an "alkylaryl" or "alkylheteroaryl" group may be substituted with any one or more of the substituents listed above for aryl, and carbocycle groups. Preferably, alkylaryl is benzyl.

The term "heteroaryl" as used herein refers to a monocyclic or bicyclic aromatic ring system having from 5 to 10 ring atoms, i.e. 5, 6, 7, 8, 9, or 10 ring atoms, at least one ring atom being a heteroatom selected from O, N or S.

An aliphatic, aryl, heteroaryl, or carbocycle group as referred to herein may be unsubstituted or may be substituted by one or more substituents independently selected from the group consisting of halo, $C_{1-6}$ alkyl, —$NH_2$, —$NO_2$, —$SO_3H$, —OH, alkoxy, —COOH, or —CN.

The term "halogen atom" or "halo" used herein means a fluorine atom, a chlorine atom, a bromine atom, an iodine atom and the like, preferably a fluorine atom or a chlorine atom, and more preferably a fluorine atom.

"$C_{2-6}$ Alkoxy" refers to the above $C_{1-6}$ alkyl group bonded to an oxygen that is also bonded to the cation ring. A "$C_{2-6}$ alkoxyalkyl group" refers to an alkyl containing an ether group, with the general formula X—O—Y wherein X and Y are each independently a $C_{1-5}$ alkyl and the total number of carbon atoms is between 2 and 6 e.g. 2, 3, 4, 5, or 6.

As used herein the term "alkenyl" refers to a linear or branched alkenyl group or moiety containing from 2 to 20 carbon atoms, such as 11, 12, 13, 14, 15, 16, 17, 18, or 19 carbon atoms. Preferably the alkenyl group or moiety contains 2-10 carbon atoms i.e. 2, 3, 4, 5, 6, 7, 8, 9, or 10 carbon atoms such as a $C_{2-4}$ alkenyl or a $C_{2-6}$ alkenyl group or moiety, for example ethenyl, 1-propenyl, 2-propenyl, 1-butenyl, 2-butenyl, 3-butenyl, 1-pentenyl, 2-pentenyl, 3-pentenyl, 4-pentenyl, 1-hexenyl, 2-hexenyl, 3-hexenyl, 4-hexenyl, and 5-hexenyl.

As used herein the term "alkynyl" refers to a linear or branched alkynyl group or moiety containing from 2 to 20 carbon atoms, such as 11, 12, 13, 14, 15, 16, 17, 18, or 19 carbon atoms. Preferably the alkynyl group or moiety contains 2-10 carbon atoms i.e. 2, 3, 4, 5, 6, 7, 8, 9, or 10 carbon atoms such as a $C_{2-4}$ alkynyl or a $C_{2-6}$ alkynyl group or moiety, for example ethynyl, 1-propynyl, 2-propynyl, 1-butynyl, 2-butynyl, 3-butynyl, 1-pentynyl, 2-pentynyl, 3-pentynyl, 4-pentynyl, 1-hexynyl, 2-hexynyl, 3-hexynyl, 4-hexynyl, and 5-hexynyl.

The disclosure provides aspects and embodiments as set out in the following clauses:

1. A method for making fibres, the method comprising:
   providing a spinning dope comprising a dope solvent, lignin dissolved in the dope solvent and a carbon nanomaterial, wherein the dope solvent comprises an ionic liquid and, optionally, water; and
   extruding the spinning dope into a coagulant to obtain one or more fibres.
2. The method of clause 1, wherein the water content in the dope solvent is 0-30 wt %.
3. The method of clause 1 or 2, wherein the water content in the dope solvent is 0-20 wt %.
4. The method of any preceding clause, wherein the water content in the dope solvent is 0-15 wt %.
5. The method of any preceding clause, wherein the water content in the dope solvent is 0-10 wt %.
6. The method of any preceding clause, wherein the water content in the dope solvent is 0-5 wt %.
7. The method of any preceding clause, wherein the dope solvent comprises at least 1 wt % water.
8. The method of any preceding clause, wherein the dope solvent comprises at least 2 wt % water.
9. The method of any preceding clause, wherein the dope solvent comprises at least 3 wt % water.
10. The method of any preceding clause, wherein the lignin is present at a loading of at least 5 wt %, relative to the total mass of the spinning dope, excluding the mass of lignin and carbon nanomaterial.
11. The method of clause 10, wherein the lignin is present at a loading of at least 10 wt %.
12. The method of clause 11, wherein the lignin is present at a loading of 10-50 wt.
13. The method of clause 12, wherein the lignin is present at a loading of 10-40 wt.
14. The method of clause 13, wherein the lignin is present at a loading of 10-30 wt %.
15. The method of any preceding clause, wherein the carbon nanomaterial is present at a loading of at least 0.001 wt %, relative to the mass of the spinning dope, excluding the mass of lignin and carbon nanomaterial.

16. The method of clause 15, wherein the carbon nanomaterial is present at a loading of at least 0.01 wt %.
17. The method of clause 16, wherein the carbon nanomaterial is present at a loading of at least 0.1 wt %.
18. The method of clause 17, wherein the carbon nanomaterial is present at a loading of 0.001-10 wt %.
19. The method of clause 18, wherein the carbon nanomaterial is present at a loading of 0.001-8 wt %.
20. The method of clause 19, wherein the carbon nanomaterial is present at a loading of 0.01-8 wt %.
21. The method of clause 20, wherein the carbon nanomaterial is present at a loading of 0.1-5 wt %.
22. The method of clause 21, wherein the carbon nanomaterial is present at a loading of 0.1-1 wt %.
23. The method of clause 22, wherein the carbon nanomaterial is present at a loading of 0.3-0.7 wt %.
24. The method of any preceding clause, wherein the weight ratio of lignin to carbon nanomaterial in the spinning dope is from 5:1 to 10000:1.
25. The method of any preceding clause, wherein the weight ratio of lignin to carbon nanomaterial in the spinning dope is from 5:1 to 5000:1.
26. The method of any preceding clause, wherein the weight ratio of lignin to carbon nanomaterial in the spinning dope is from 10:1 to 1000:1.
27. The method of any preceding clause, wherein the weight ratio of lignin to carbon nanomaterial in the spinning dope is from 20:1 to 200:1.
28. The method of any preceding clause, wherein the carbon nanomaterial is dispersed in the dope solvent.
29. The method of any preceding clause, wherein the carbon nanomaterial comprises carbon nanotubes, carbon nanoribbons, graphene nanoplates or a combination thereof.
30. The method of clause 29, wherein the carbon nanomaterial comprises carbon nanotubes.
31. The method of clause 30, wherein the carbon nanotubes are single-walled carbon nanotubes (SWCNTs).
32. The method of any preceding clause, wherein the ionic liquid comprises a cation and an anion, wherein the anion is selected from $C_{1-20}$ alkyl sulfate ($[AlkylSO_4]^-$), $C_{1-20}$ alkylsulfonate ($[AlkylSO_3]^-$), hydrogen sulfate ($[HSO_4]^-$), hydrogen sulphite ($[HSO_3]^-$), dihydrogen phosphate ($[H_2PO_4]^-$), hydrogen phosphate ($[HPO_4]^{2-}$), chloride ($Cl^-$), bromide ($Br^-$), trifluoromethanesulfonate ($[oTf]^-$), formate ($[HCOO]^-$) and acetate ($[MeCO_2]^-$).
33. The method of clause 32, wherein the anion is selected from $[HSO_4]^-$ and $[HCOO]^-$.
34. The method of any preceding clause, wherein the ionic liquid comprises a cation and an anion, wherein the cation is a protic cation.
35. The method of any preceding clause, wherein the ionic liquid comprises a cation and an anion, wherein the cation contains a nitrogen-containing heterocyclic moiety or wherein the cation is a cation of Formula I

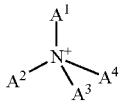

wherein $A^1$ to $A^4$ are each independently selected from H, an aliphatic, $C_{3-6}$ carbocycle, $C_{6-10}$ aryl, alkylaryl, and heteroaryl.

36. The method of any preceding clause, wherein the ionic liquid is an [alkylammonium][$HSO_4$] or [alkylammonium][HCOO] ionic liquid.
37. The method of any preceding clause, wherein the ionic liquid is triethylammonium hydrogen sulfate [TEA][$HSO_4$], N,N-dimethylbutylammonium hydrogen sulfate [DMBA][$HSO_4$], diethylammonium hydrogen sulfate [DEA][$HSO_4$], N,N-dimethylethylammonium hydrogen sulfate ([DMEA][$HSO_4$]), diethanolammonium chloride [DEtOHA]Cl, 1-methylimidazolium hydrogen chloride [HMim]Cl, 1-ethyl-3-methylimidazolium chloride [EMim]Cl, and 1-ethyl-3-methylimidazolium trifluoromethanesulfonate [EMim][OTf]. 1-butylimidazolium hydrogen sulfate ([HBim][$HSO_4$]), methylbutylammonium hydrogen sulfate ([MBA][$HSO_4$]), 1-methylimidazolium formate ([HMim][HCOO]), N,N-dimethylbutylammonium formate ([DMBA][HCOO]), N,N-dimethylethylammonium hydrogen sulfate ([DMEA][$HSO_4$]), 1-butyl-3-methylimidazolium hydrogen sulfate [BMim][$HSO_4$], or N-dimethylbutylammonium acetate ([DMBA][OAc]), or a mixture thereof.
38. The method of any preceding clause, wherein the ionic liquid is N,N-dimethylethylammonium hydrogen sulfate ([DMEA][$HSO_4$]), N,N-dimethylbutylammonium hydrogen sulfate ([DMBA][$HSO_4$]), 1-butylimidazolium hydrogen sulfate ([HBim][$HSO_4$]), triethylammonium hydrogen sulfate ([TEA][$HSO_4$]), methylbutylammonium hydrogen sulfate ([MBA][$HSO_4$]), 1-methylimidazolium formate ([HMim][HCOO]), N,N-dimethylbutylammonium formate ([DMBA][HCOO]), 1-methylimidazolium hydrogen chloride [HMim]Cl, N,N-dimethylbutylammonium chloride [DMBA]Cl, 1-butyl-3-methylimidazolium hydrogen sulfate [BMim][$HSO_4$], or N-dimethylbutylammonium acetate ([DMBA][oAc]), or a mixture thereof.
39. The method of any preceding clause, wherein the ionic liquid is N,N-dimethylbutylammonium hydrogen sulfate ([DMBA][$HSO_4$]), 1-butylimidazolium hydrogen sulfate ([HBim][$HSO_4$]), triethylammonium hydrogen sulfate ([TEA][$HSO_4$]), methylbutylammonium hydrogen sulfate ([MBA][$HSO_4$]), 1-methylimidazolium formate ([HMim][HCOO]), N,N-dimethylbutylammonium formate ([DMBA][HCOO]), 1-methylimidazolium hydrogen chloride [HMim]Cl, N,N-dimethylbutylammonium chloride [DMBA]Cl, 1-butyl-3-methylimidazolium hydrogen sulfate [BMim][$HSO_4$], or N-dimethylbutylammonium acetate ([DMBA][OAc]), or a mixture thereof.
40. The method of any preceding clause, wherein the ionic liquid is N,N-dimethylbutylammonium hydrogen sulfate ([DMBA][$HSO_4$]), 1-butylimidazolium hydrogen sulfate ([HBim][$HSO_4$]), triethylammonium hydrogen sulfate ([TEA][$HSO_4$]), methylbutylammonium hydrogen sulfate ([MBA][$HSO_4$]), 1-methylimidazolium formate ([HMim][HCOO]), or N,N-dimethylbutylammonium formate ([DMBA][HCOO]), or a mixture thereof.
41. The method of any preceding clause, wherein the ionic liquid is [DMBA]Cl, [DMBA][$HSO_4$], [BMim][$HSO_4$], [MBA][$HSO_4$] or [HBim][$HSO_4$], or a mixture thereof.
42. The method of any preceding clause, wherein the ionic liquid is [DMBA][$HSO_4$].

43. The method of any preceding clause, wherein the dope solvent further comprises ethanol.
44. The method of clause 43, wherein the ethanol is present at 1-20 wt % of the dope solvent, relative to the total weight of dope solvent.
45. The method of clause 44, wherein the ethanol is present at 5-15 wt %.
46. The method of any of clauses 43 to 45, wherein the ionic liquid:ethanol mass ratio is from 3:1 to 15:1.
47. The method of any of clauses 43 to 46, wherein the ionic liquid:ethanol mass ratio is from 5:1 to 12:1.
48. The method of any preceding clause, wherein the spinning dope has a water content of at least 5 wt %, calculated based on the mass of water present relative to the mass of the spinning dope, excluding the mass of lignin and carbon nanomaterial.
49. The method of any preceding clause, wherein the spinning dope has a water content of 5-40 wt %, calculated based on the mass of water present relative to the mass of the spinning dope, excluding the mass of lignin and carbon nanomaterial.
50. The method of any preceding clause, wherein the spinning dope has a water content of 10-40 wt %, calculated based on the mass of water present relative to the mass of the spinning dope, excluding the mass of lignin and carbon nanomaterial.
51. The method of any preceding clause, wherein the spinning dope has a water content of 20-40 wt %, calculated based on the mass of water present relative to the mass of the spinning dope, excluding the mass of lignin and carbon nanomaterial.
52. The method of any preceding clause, wherein the coagulant comprises water.
53. The method of any preceding clause, wherein the coagulant comprises water and ionic liquid, wherein the ionic liquid is present at no more than 60 wt %, relative to the total mass of coagulant.
54. The method of any preceding clause, wherein the coagulant comprises water and ionic liquid, wherein the ionic liquid is present at no more than 30 wt %, relative to the total mass of coagulant.
55. The method of any preceding clause, wherein the coagulant comprises water and ionic liquid, wherein the ionic liquid is present at no more than 15 wt %, relative to the total mass of coagulant.
56. The method of any preceding clause, wherein the coagulant comprises water and ionic liquid, wherein the ionic liquid is present at 1-60 wt %, relative to the total mass of coagulant.
57. The method of any preceding clause, wherein the coagulant comprises water and ionic liquid, wherein the ionic liquid is present 1-30 wt %, relative to the total mass of coagulant.
58. The method of any preceding clause, wherein the coagulant comprises water and ionic liquid, wherein the ionic liquid is present at 1-15 wt %, relative to the total mass of coagulant.
59. The method of any preceding clause, wherein the coagulant comprises water and ionic liquid, wherein the ionic liquid is present at 5-15 or 5-10 wt %, relative to the total mass of coagulant.
60. The method of any preceding clause, wherein the coagulant comprises water and sodium sulfate.
61. The method clause 60, wherein the coagulation bath comprises aqueous sodium sulfate at a concentration of 0.5-1.5M.
62. The method of any preceding clause, wherein the providing the spinning dope comprises:
    a) dissolving lignin in the dope solvent to obtain a lignin solution;
    b) combining the lignin solution with the carbon nanomaterial; and
    c) dispersing the carbon nanomaterial in the dope solvent to obtain the spinning dope, optionally by shearing.
63. The method of clause 62, wherein dissolution of the lignin is performed at a temperature of 10 °C to 100 °C.
64. The method of clause 63, wherein dissolution of the lignin is performed at a temperature of 20 °C to 60 °C.
65. The method of clause 64, wherein dissolution of the lignin is performed at a temperature of 20 °C to 30 °C.
66. The method of any preceding clause, wherein the spinning dope is prepared by a process comprising preparing a lignin solution and combining the lignin solution with the carbon nanomaterial.
67. The method of clause 66, wherein the lignin solution is prepared by:
    a) contacting a lignocellulosic biomass comprising lignin and cellulose with a composition comprising an ionic liquid and water to dissolve the lignin and produce a cellulose pulp;
    b) separating the cellulose pulp to obtain a liquor comprising the ionic liquid, water and lignin; and
    c) optionally adjusting the amount of ionic liquid and/or water in the liquor to obtain the lignin solution.
68. The method of clause 62, 66 or 67, further comprising aging the lignin solution for at least 2 minutes prior to the combining with the carbon nanomaterial.
69. The method of clause 62, 66 or 67, further comprising aging the lignin solution for at least 5 minutes prior to the combining with the carbon nanomaterial.
70. The method of clause 62, 66 or 67, further comprising aging the lignin solution for at least 30 minutes prior to the combining with the carbon nanomaterial.
71. The method of clause 62, 66 or 67, further comprising aging the lignin solution for at least 1 hour prior to the combining with the carbon nanomaterial.
72. The method of clause 62, 66 or 67, further comprising aging the lignin solution for at least 1 day prior to the combining with the carbon nanomaterial.
73. The method of clause 62, 66 or 67, further comprising aging the lignin solution for at least 5 days prior to the combining with the carbon nanomaterial.
74. The method of clause 62, 66 or 67, further comprising aging the lignin solution for at least 10 days prior to the combining with the carbon nanomaterial.
75. The method of any of clauses 68-74, wherein the lignin solution is heated during aging at a temperature of at least 30 °C.
76. The method of any of clauses 68-74, wherein the lignin solution is heated during aging at a temperature of at least 60 °C.
77. The method of any of clauses 68-76, wherein the lignin solution is heated during aging at a temperature of up to 150 °C.
78. The method of any of clauses 67-77, wherein the composition comprising the ionic liquid and water has a 2-40 wt % water content.
79. The method of clause 78, wherein the composition comprising the ionic liquid and water has a 5-40 wt % water content.

80. The method of clause 79, wherein the composition comprising the ionic liquid and water has a 5-10 wt % water content.
81. The method of any of clauses 67-80, wherein the lignocellulosic biomass contacted with the composition is heated to 100-180 °C.
82. The method of any of clauses 67-80, wherein the lignocellulosic biomass contacted with the composition is heated to 120-170 °C.
83. The method of any of clauses 67-80, wherein the lignocellulosic biomass contacted with the composition is heated to 120-150 °C.
84. The method of any of clauses 67-83, wherein the lignocellulosic biomass is contacted with the composition for 1 minute to 22 hours.
85. The method of any of clauses 67-83, wherein the lignocellulosic biomass is contacted with the composition for 10 minutes to 22 hours.
86. The method of any of clauses 67-83, wherein the lignocellulosic biomass is contacted with the composition for 10 minutes to 10 hours.
87. The method of any of clauses 67-83, wherein the lignocellulosic biomass is contacted with the composition for 15 minutes to 8 hours.
88. The method of any of clauses 67-83, wherein the lignocellulosic biomass is contacted with the composition for 30 minutes to 8 hours.
89. The method of any preceding clause, further comprising drying the one or more fibres under mechanical tension.
90. The method of any preceding clause, further comprising heating the one or more fibres in air.
91. The method of clause 90, comprising heating the one or more fibres in air at 150-300 °C.
92. The method of any preceding clause, further comprising carbonising the one or more fibres to obtain carbon fibres.
93. The method of clause 92, wherein carbonising comprises heating the one or more fibres to 800-3000 °C, under an inert atmosphere.
94. The method of clause 93, wherein carbonising comprises heating the one or more fibres to 1200-1800 °C, under an inert atmosphere.
95. The method of any preceding clause, wherein the spinning dope comprises a cellulose loading of no more than 10 wt %, relative to the mass of spinning dope, excluding the mass of cellulose, lignin and carbon nanomaterial.
96. The method of any preceding clause, wherein the spinning dope comprises a cellulose loading of no more than 5 wt %.
97. The method of any preceding clause, wherein the spinning dope comprises a cellulose loading of no more than 4 wt %.
98. The method of any preceding clause, wherein the spinning dope comprises a cellulose loading of no more than 1 wt %.
99. A fibre obtainable by the method of any of the preceding clauses.
100. A fibre obtained by the method of any of the preceding clauses.
101. A spinning dope comprising, a dope solvent, lignin and a carbon nanomaterial, wherein the dope solvent comprises an ionic liquid and optionally water.
102. A dispersion comprising carbon nanotubes and [DMBA][$HSO_4$].
103. The dispersion of clause 102, wherein the dispersion is a dispersion of carbon nanotubes in any dope solvent as described in any of the preceding clauses, wherein the ionic liquid is [DMBA][$HSO_4$].

The present invention will now be described by way of reference to the following examples and accompanying drawings which are present for the purposes of illustration only and are not to be construed as being limiting on the invention.

EXAMPLES

Materials

Optical micrographs were observed visually on a Leica DM2500 optical microscope connected to a Basler camera and associated software to capture and process images.

Single walled nanotubes (SWCNTs) were obtained from OCSiAl. TUBALL 75 (<2 nm diameter, >1 μm length, >15% of metal impurities). TUBALL 99 (>2 nm diameter, >5 μm length, <1% metal impurities).

*Eucalyptus* biomass (*Eucalyptus grandis*), a hardwood lignin, was obtained from W.L West & sons Ltd. Ethanol (absolute) was purchased from VWR.

Lignin extraction was carried out following the ionoSolv pretreatment procedure (Gschwend, F. J. v. et al. *Journal of Visualized Experiments* 2016, 2016 (114), 4-9).

Methods

Example 1. Ionic Liquid Synthesis

The ionic liquid [DMBA][$HSO_4$] was synthesised from N,N-dimethylbutylamine and a 66.3% sulfuric acid solution in a custom-built flow reactor. All reagents were used as received. The precursors were chilled and pumped into a stirred flow reactor at flow rates of 5 ml/min for the acid and 7.8 ml/min for the base. The acid/base ratio of the produced IL was checked in triplicate using an automatic titrator (Mettler Toledo G205), where the $HSO_4^-$ anion was titrated with aqueous NaOH. For the correction of the acid/base ratio, a calculated amount of DMBA or 66.3% sulfuric acid was gradually added to the IL cooled in an ice bath.

The water content of the IL was measured with a volumetric Karl Fischer titrator (Mettler Toledo). The IL was determined to have an initial water content of 4.22%. This was adjusted as required by adding more water, the desired water content being 4.74-5%. [DMBA][$HSO_4$]$_{95\%}$/water$_{5\%}$ will be denoted as DH5. Lignin (12 wt %) dissolved in DH5 will be denoted as lig-DH5.

Example 2: SWCNT Dispersion in DH5

1) SWCNTs (2 mg, TUBALL 99% pure) were added to mortar (marble). The ionic liquid water mixture (DH5, 200 mg) was drawn into a syringe and added dropwise, starting with the minimum amount of two drops (38 mg). Transfer loss may occur from the syringe, therefore the weight of the syringe was recorded on a balance after each addition and the added mass of DH5 calculated from equation 1.
2) The minimum amount of DH5 (38 mg) was ground with SWCNTs (5.2 wt %) using a pestle for 7-10 minutes, applying high shear to break up large aggregates until a smooth paste formed. The mixture was ground for a total of 30 minutes.

3) A small amount of the dispersion was placed on a labelled glass slide and covered with a cover slip for analysis via optical microscopy (OM).

$$\text{wt \% of } SWNTs = \left[\frac{\text{Mass of } SWNTs(\text{mg})}{\text{Mass of solvent (mg)}}\right]100 \quad \text{Eq. 1}$$

Dispersion of SWCNTs in [DMBA][$HSO_4$] were prepared at various concentrations. Dispersion of SWCNTs in [DMBA][$HSO_4$] afforded different sample textures at concentrated and dilute concentrations. The consistency of the 5.2 wt % dispersion (15 min shear) resembled a dry, smooth solid that held shape when cut in half. Conversely, diluted samples, containing 1.3 wt % and 0.5 wt % SWCNTs, were analogous to gels or soft solids. They formed a wet paste and a grey film when placed on glass slides for analysis via OM.

High purity pristine SWCNTs (TUBALL 99) were dispersed in DH5 to afford a uniform and adequate dispersion free of large aggregates at optimised conditions.

Rheology

SWCNT dispersions in DH5 were found to decrease in viscosity when increasing the shear rate (shear-thinning, results for SWCNT dispersions at 0.25, 0.5 and 1 wt % of SWCNT are shown in FIG. 1). Shear thinning is caused by dissolved and dispersed materials disentangling or aligning in flow and can be beneficial for generating alignment in spun fibre, which in turn may generate improved graphitic structure in the resulting carbon fibres.

The viscosity of the SWCNT dispersion was measured using an AR 2000ex rheometer with a cone-and-plate feature (2° cone angle, 20 mm plate diameter and 53 μm gap).

Measurements were conducted at 25 °C. (RT) for dynamic steady, strain, and time sweeps. The stability of the gels/dopes was measured over 30 minutes at a constant strain of 1.5% and frequency of 0.1 rad/s. Strain sweeps were performed straight after to identify the linear viscoelastic region (LVR) where strain % was set from 0.1%-1000% at an angular frequency of 10 rad/s. The LVR was identified around 1-2% for all gels and therefore a frequency sweep was conducted at 1.5% strain at a frequency range of 0.1-100 rad/s to identify the gels/dopes dominant behaviour.

The zero-shear rate viscosity was measured using an AR 2000ex rheometer with a cone-and-plate feature (2° cone angle, 20 mm plate diameter and 53 μm gap) at low shear rates from 3.00×10-6 to 30 s-1 at room temperature. The zero-shear rate was recorded at between 117,100-101,300 Pa·s at $1.01\times10^{-4}$-$4.65\times10^{-4}$ $s^{-1}$ shear rates for the 0.5 (w/w) % dispersion in DH5.

Strain

Figure 2:
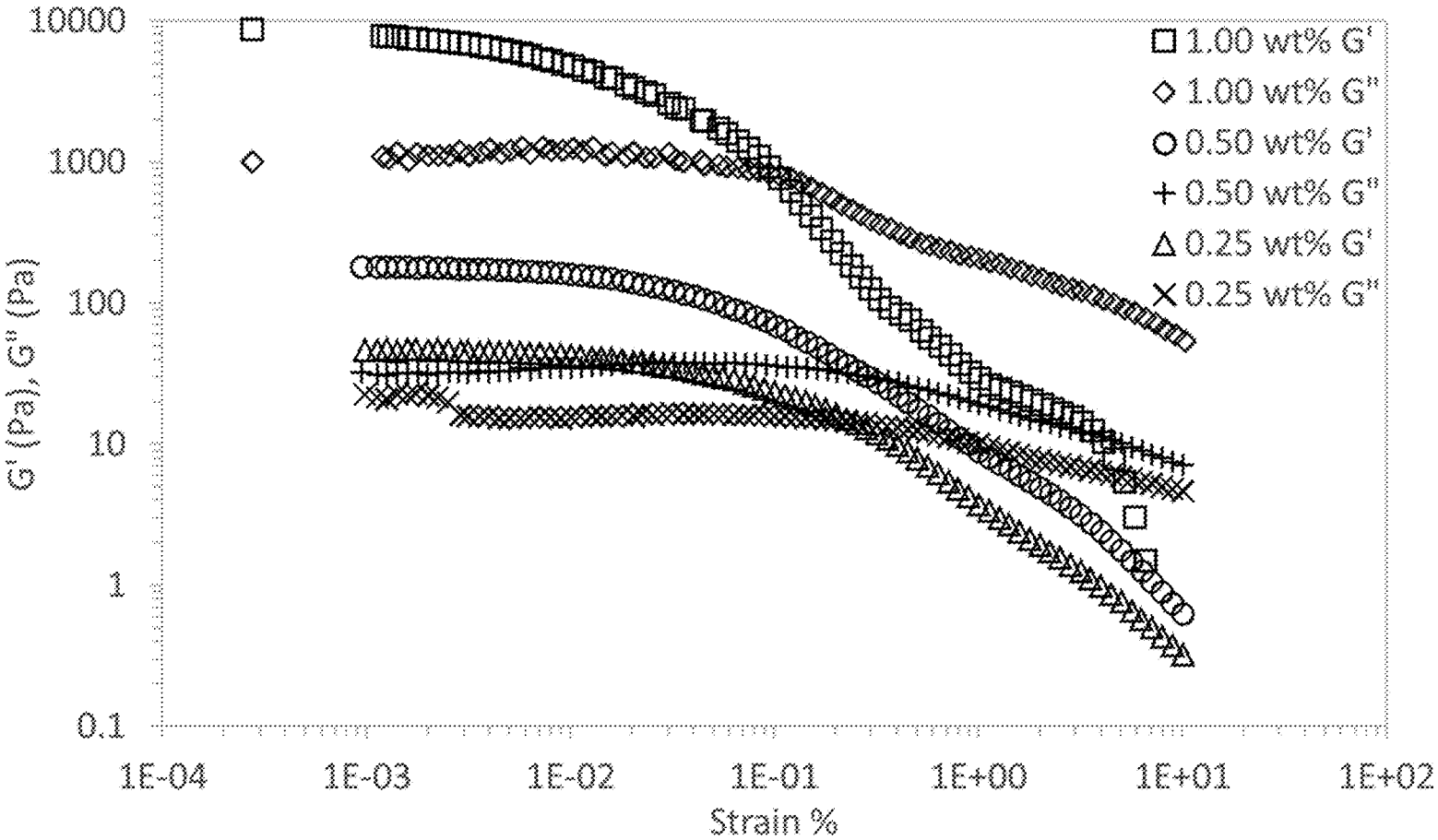
FIG. 2 shows a strain sweep for fibres produced as described herein.
Figure 3:
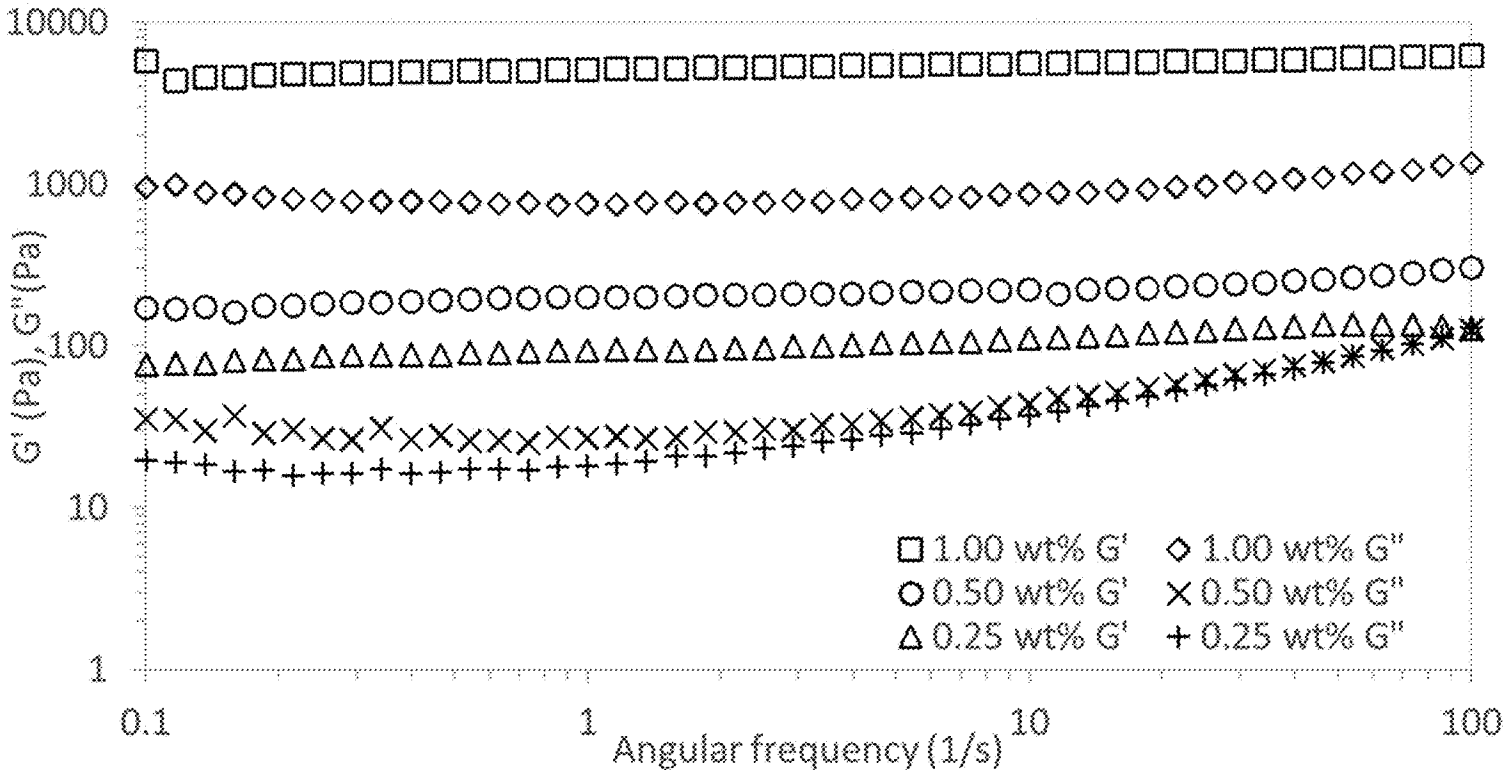
FIG. 3 shows frequency sweeps for fibres produced as described herein.

A strain sweep identified the linear viscoelastic region (LVR) at 1.5-2% and the critical strain at 12-29% (FIG. 2). The LVR enabled the identification of the gels' dominant behaviour which was characterised by a frequency sweep. It was found that the G' values (elastic behaviour) increased as the concentration of SWCNTs increased, suggesting the formation of an elastic network at higher concentrations (FIG. 3, 1.0 wt %). All gels were found to be elastically dominant (0.25, 0.5 and 1.0 wt %)

Example 3: Preparation of Composite Dope and Wet Spinning of Lignin Nanocomposite Fibres 1) To a flask containing a stirrer bar and the ionic liquid solution DH5, lignin was added to achieve a 12 wt % polymer loading. The flask was secured above an oil/water bath, heated to 60 °C and left to stir for 1.5 h (900 RPM). The homogeneity of the solution was checked via OM.
2) Lig-DH5 was drawn into a 1 ml syringe and the weight recorded. The minimum amount of lig-DH5 was added dropwise (50-70 mg) into a mortar containing SWCNTs (0.5 wt %, TUBALL 99). The minimum amount of lig-DH5 and SWCNTs were sheared vigorously with pestle for 15 minutes. The rest of the mixture was added gradually over 30 minutes, each time applying high shear to disperse the SWCNTs, generating a lignin CNT composite dope. The shearing time was extended if the volume of SWCNTs was increased (>4 mg).
3) Once a good dispersion was obtained and viewed via OM, the composite dope was drawn into a syringe. The composite dope was wet-extruded with a syringe pump (needle diameter can range from 24-27 G, extrusion rate 0.009 ml/min) into a rotational coagulation bath containing deionised water. The fibres were left to coagulate for 15 minutes and carefully secured on a drying stand with tape. A foil weight (10-20 mg) is placed at the bottom of the fibres.

Lig-DH5 alone without an additive was not spinnable in deionised (DI) water. Conversely, lignin was spinnable when SWCNTs were incorporated into the dope. Fibres containing lignin (96%) and SWCNTs (4%) were spun continuously and could hold shape after 30 minutes of coagulation in DI water. The SWCNTs were dispersed adequately in lig-DH5, and the fibre surface had domains of smooth textures and uniformity.

Figure 4:
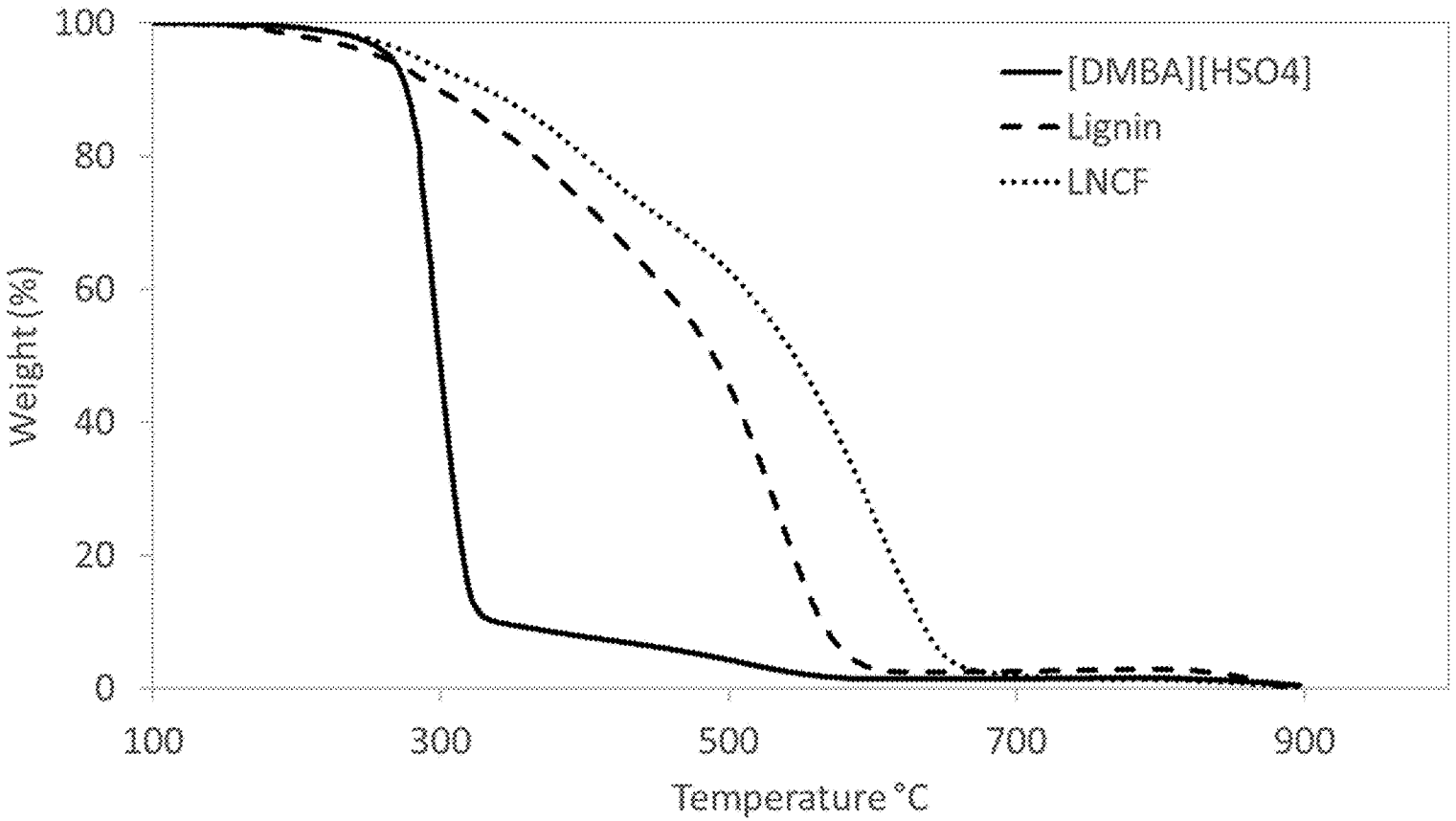
FIG. 4 shows a thermogravimetric analysis (TGA) graph for TGA experiments carried out in air (LNCF=lignin nanocomposite fibres).
Figure 5:
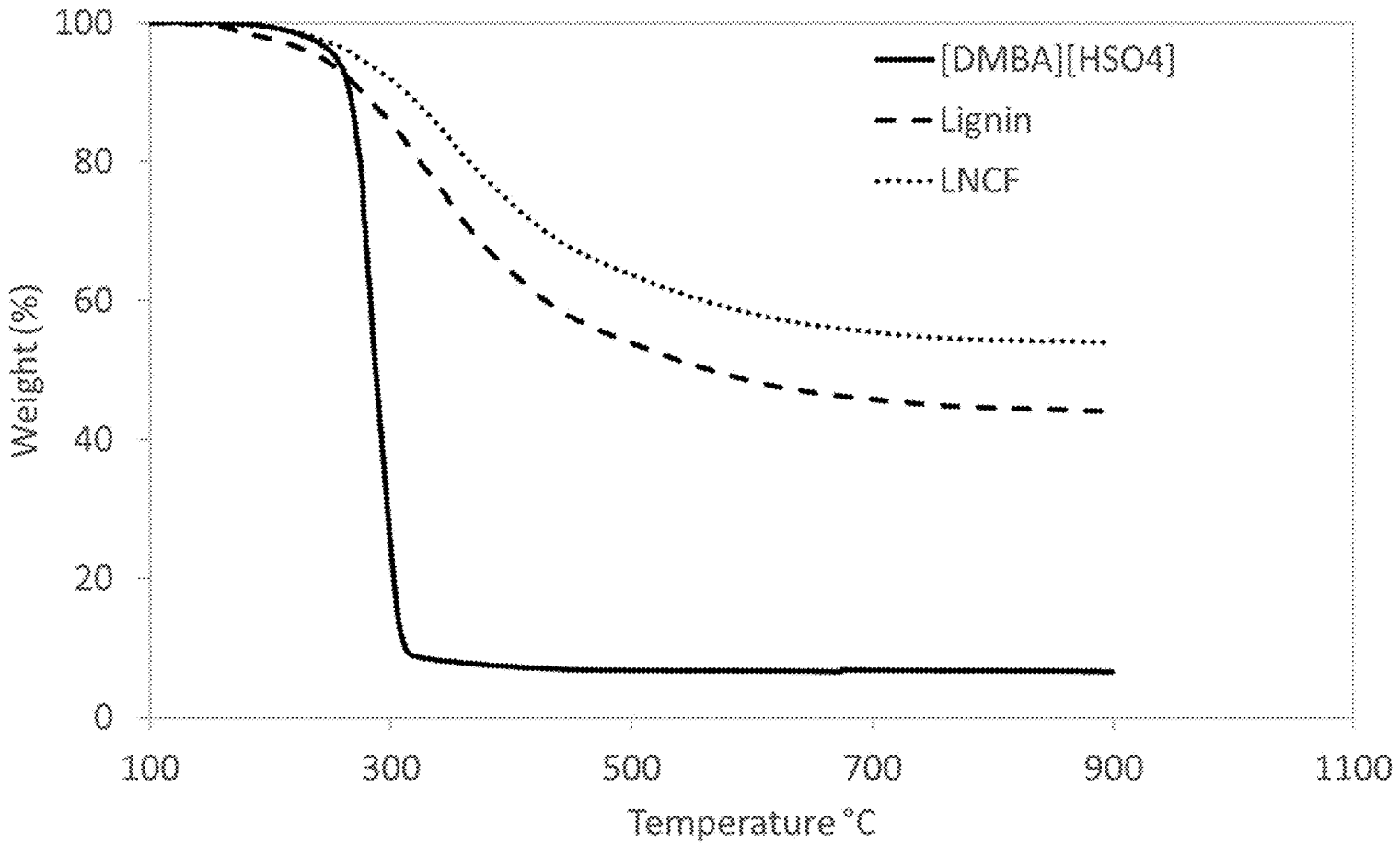
FIG. 5 shows TGA curves for heating carried out in nitrogen.

Thermogravimetric analysis (TGA) was carried out to imitate the carbonisation process that takes place with precursor fibres. After drying overnight, the lignin CNT composite fibres were analysed by TGA which was performed on a Mettler Toledo TGA/DSC 1LF/UMX. The samples were heated in platinum pans at 10 °C min-1 flow of nitrogen from 25 °C to 100 °C, held isothermally at 100 °C for 30 min to drive off moisture and the temperature was ramped to 900 °C at 10 °C $min^{-1}$. The process was repeated in air. Results are shown in FIGS. 4 and 5. FIG. 5 shows that pyrolysis in $N_2$ yielded 54.0% carbon yield.

Example 4. Integrated Lignin Extraction and Lignin Fibre Spinning

Biomass Pretreatment (Lignin Extraction in [DMBA][$HSO_4$])

The lignin extraction was carried out following the iono-Solv pretreatment procedure (Gschwend, F. J. V et al. *J. Vis. Exp.* 2016, 2016 (114), 4-9). 9 or 12 g (oven dry-basis, ODW) biomass was added into a 100 mL pressure tube (Ace Glass, Vineland, NJ, USA, front sealing), followed by adding ca. 30 g [DMBA][$HSO_4$]$_{83\%}$/water$_{17\%}$ to obtain a suspension of 30% or 40% biomass loading and 20% water content. The biomass and ionic liquid solution were well-mixed with a vortex shaker (VWR) until all biomass particles were in contact with the IL. The pressure tubes were placed in a preheated oven for 1 h at 150 °C. The mixture in the pressure tubes was cooled and transferred into a 500 mL glass bottle, followed by mixing with 180 g absolute ethanol (EtOH), shaken well and left to rest for 1 h at room temperature. After 1 h, the mixture was separated into a cellulose rich solid and liquid containing ionic liquid, ethanol and the dissolved lignin (liquor) using vacuum filtration. The cellulose was air-dried. The pulp was washed with EtOH three more times, followed by Soxhlet extraction in ethanol for 24 h. The liquor was collected and the majority of the water and the EtOH evaporated from the combined liquor fractions using a rotary evaporator. The lignin extraction was carried out in triplicate. Liquors obtained from 30% and 40% biomass loading lignin extraction are labelled as Liquor 30 and Liquor 40.

Compositional Analysis of Biomass and Pulp

Compositional analysis was carried out according to a published standard procedure by the National Renewable Energy Laboratory (NREL) (Sluiter, A. et al, *Natl. Renew. Energy Lab.* 2008, No. April 2008, 17). Extractives were removed from ground eucalyptus wood using EtOH with a Soxhlet extractor for 24 h and the extractives content quantified by measuring the weight difference. Around 300 mg of air-dry extract-free biomass (oven-dried weight basis, sieved to 180-850 μm) or recovered pulp was weighed out into a 100 ml pressure tube (Ace Glass) and the exact weight recorded. 3 mL of 72% sulfuric acid (Fluka) were added, and the samples stirred with a Teflon stir rod and the pressure tubes placed into a preheated water bath at 30 °C. The samples were stirred again every 10 min for 1 h. They were then diluted with 84 mL distilled water and a lid added. The samples were autoclaved for 1 h at 121 °C. (Sanyo Labo Autoclave ML5 3020 U) and left to cool to close to ambient temperature. The samples were filtered through filtering ceramic crucibles of a known weight. The filtrate was filled into two Falcon tubes (for acid soluble lignin content and sugar content determination) and the black solid washed with distilled water. The crucibles containing the acid-insoluble lignin and ash were dried in a convection oven (VWR Venti-Line 115) at 105 °C for 24±2 h. They were placed in a desiccator for 15 min before their weight was recorded. The crucibles were placed into a muffle oven (Nabertherm+controller P 330) and ashed to constant weight at 575 °C. They were again placed in a desiccator for 15 min before their weight was again recorded. The content of acid insoluble lignin (AIL) was determined according to Equation 1:

$$\%\ AIL = \frac{Wcrucible\ \text{plus}\ AIR - Wcrucible\ \text{plus ash}}{ODWsample} \cdot 100\% \quad (1)$$

where Wcrucible plus AIR is the weight of the oven-dried crucible plus the acid insoluble residue, Wcrucible plus ash is the weight of the crucible after ashing to constant temperature at 575 °C.

The acid soluble lignin content (ASL) was determined by UV analysis of the autoclaving filtrate at 286 nm (Perkin Elmer Lambda 650 UV/Vis spectrometer). 200 μL sample and 800 μL D.I. water were added in the cuvette (dilution 1:4), mixed well and the absorption A recorded. The ASL was calculated according to Equation 2:

$$\%\ ASL = \frac{A}{l \cdot \varepsilon \cdot c} \cdot 100\% = \frac{A \cdot Vfiltrate}{l \cdot \varepsilon \cdot ODWsample} \cdot 100\% \quad (2)$$

where A is the absorbance at 286 nm, 1 is the path length of the cuvette in cm (1 cm in this case), ε is the extinction coefficient (25 L/g cm), c is the concentration in mg/mL, ODW is the oven-dried weight of the sample in mg and $V_{filtrate}$ is the volume of the filtrate in mL and equal to 86.73 mL.

Calcium carbonate was added to the remaining filtrate until the solution pH reached 5. The liquid was filtered through a 0.2 μm PTFE syringe filter and submitted to HPLC analysis for the determination of total sugar content (Shimadzu, Aminex HPX-97P from Bio rad, 300×7.8 mm, purified water as mobile phase at 0.6 ml/min, column temperature 85 °C.). Calibration standards with concentrations of 0.1, 1, 2 and 4 mg/mL of glucose, xylose, mannose, arabinose and galactose were used. Sugar recovery standards were made up as 10 mL aqueous solutions close to the expected sugar concentration of the samples and transferred to pressure tubes. 278 μL 72% sulfuric acid was added, the pressure tube closed and autoclaved and the sugar content determined as described above. Sugar recovery coefficient (SRC) and the sugar content of the analysed sample were determined according to Equation 3 and Equation 4, respectively:

$$SRC = \frac{cHPLC \cdot V}{\text{initial weight}} \cdot 100 \quad (3)$$

$$\%\ \text{Sugar} = \frac{cHPLC \cdot V \cdot corranhydro}{SRC \cdot ODWsample} \cdot 100\% \quad (4)$$

where cHPLC is the sugar concentration detected by HPLC, V is the initial volume of the solution in mL (10.00 mL for the sugar recovery standards and 86.73 mL for the samples), initial weight is the mass of the sugars weighed in, corranhydro is the correction for the mass increase during hydrolysis of polymeric sugars obtained by dividing the molecular weight of one polymeric sugar by its monomeric weight (0.90 for C6 sugars glucose, galactose and mannose and 0.88 for C5 sugars xylose and arabinose) and ODW is the oven-dried weight of the sample in mg.

Determination of Liquor Composition

The lignin content of IL/lignin solution (liquor) used for spinning was calculated based on the difference in the lignin content of the raw biomass and the lignin content in the ionosolv pulp (as determined by compositional analysis), the pulp yield (oven-dried weight basis) and the weight of obtained liquor. Equations were shown below (equation 5, 6 and 7):

$$W_{lignin(biomass)} = (\%\ AIL + \%\ ASL) \cdot ODWbiomass \quad (5)$$

$$W_{lignin(pulp)} = (\%\ AIL + \%\ ASL) \cdot ODWpulp \quad (6)$$

$$\%\ \text{Lignin}(lq) = \frac{W_{lignin(biomass)} - W_{lignin(pulp)}}{W_{liquor}} \cdot 100\% \quad (7)$$

where $W_{lignin(biomass)}$ and $W_{lignin(pulp)}$ are the weight of lignin in the raw biomass and the eucalyptus pulp, respectively; ODWbiomass and ODWpulp are the oven-dried weight of raw wood and pulp, respectively; % Lignin(lq) is the lignin concentration in weight percent in the liquor and $W_{liquor}$ is the weight of liquor.

The water content was determined using a coulometric Karl-Fischer titrator. The ionic liquid and residual ethanol contents were determined using a $^1$H-NMR spectrum of the liquor. The signals of the methyl group on ethanol (δH (400 MHz, DMSO-d6)/ppm: 1.05, t) and signal of the methyl groups on the butyl chain of [DMBA][$HSO_4$] (δH (400 MHz, DMSO-d6)/ppm: 0.90, t) were used for calculating of the molar ratio of IL and EtOH, which was converted to a weight ratio by multiplication with the molecular weight of each molecule. The IL and EtOH content in the liquor can be calculated following equation (8) and (9):

$$\% \ IL(lq) = (1 - \% \ \text{Lignin}(lq) - \% \ \text{Water} \ (lq)) \cdot \frac{W_{\% \ IL,EtOH}}{1 + W_{\% \ IL,EtOH}} \quad (8)$$

$$\% \ EtOH(lq) = (1 - \% \ \text{Lignin}(lq) - \% \ \text{Water} \ (lq)) \cdot \frac{1}{1 + W_{\% \ IL,EtOH}} \quad (9)$$

where % IL(lq), % EtOH(lq) and % Water(lq) are IL, EtOH and water weight percentage in the liquor respectively. $W_{\% \ IL,EtOH}$ is the weight ratio of IL and EtOH calculated from molar ratio obtained from the $^1$H-NMR spectrum analysis.

Preparation of Spinning Dope

Spinning dope may be prepared by adding carbon nanomaterial to the liquor produced in the preceding step, optionally also adjusting water content if required. Shearing can be applied to disperse the carbon nanomaterial to provide the spinning dope. This spinning dope may then be extruded into a coagulant as described herein to produce fibres.

Example 5. Aging Study

This example investigates the effects of the length of time that the lignin solution (lignin dissolved in [DMBA][$HSO_4$] with 5% water content) is stored. Two experiments were carried out. One experiment was carried out on the lignin solution was prepared (0-day experiment) and the other was carried out after 1 month (30 days).

Method

1. A solution was prepared containing lignin (12 wt %) dissolved in [DMBA][$HSO_4$] (containing 5.02% of $H_2O$) using a THINKY mixer (ARM-310) for 1 hour at 2000 rpm.
2. This solution was used to disperse single-walled nanotubes (SWNTs) in a pestle and mortar for 60 min. The spinning dope was transferred to a syringe and wet-spun with a 27 G needle into a rotating coagulation bath containing $H_2O$ (200 ml) at an extrusion rate of 0.009 ml/min.
3. The fibres were coagulated for 15 min, picked up with tweezers and suspended on a drying line with a foil weight (15-20 mg) to keep them straight and under tension.
4. The remaining lignin solution in [DMBA][$HSO_4$] was left to age for a month (30 days) and then used to disperse the SWNTs in the same manner with the pestle and mortar.
5. The dope with the aged lignin solution (30-day) was transferred to a syringe and wet-spun in the same manner as mentioned above.
6. The 30-day fibres spun continuously and had more fibre integrity than the 0-day fibres and therefore the 30-day fibres were thermally stabilised via heat treatment (25 to 100 °C at 1 °C/min then from 100 to 250 °C at 0.2 °C/min holding at 250 °C for 1 hour) and then subsequently carbonised to 1000 °C at 1 °C/min holding at 1000 °C for 1 hour.
7. The fibres were collected and prepared for tensile testing.

Optical Microscopy

There were no visual differences between the dope samples when examining them by optical microscopy. The quality of dispersion of SWNTs for both was of good quality (well dispersed CNTs) which was assessed by the absence of large CNT aggregates (>20 μm). As most of the dope appeared homogenous, they were deemed suitable for wet spinning.

Rheology

Figure 6:
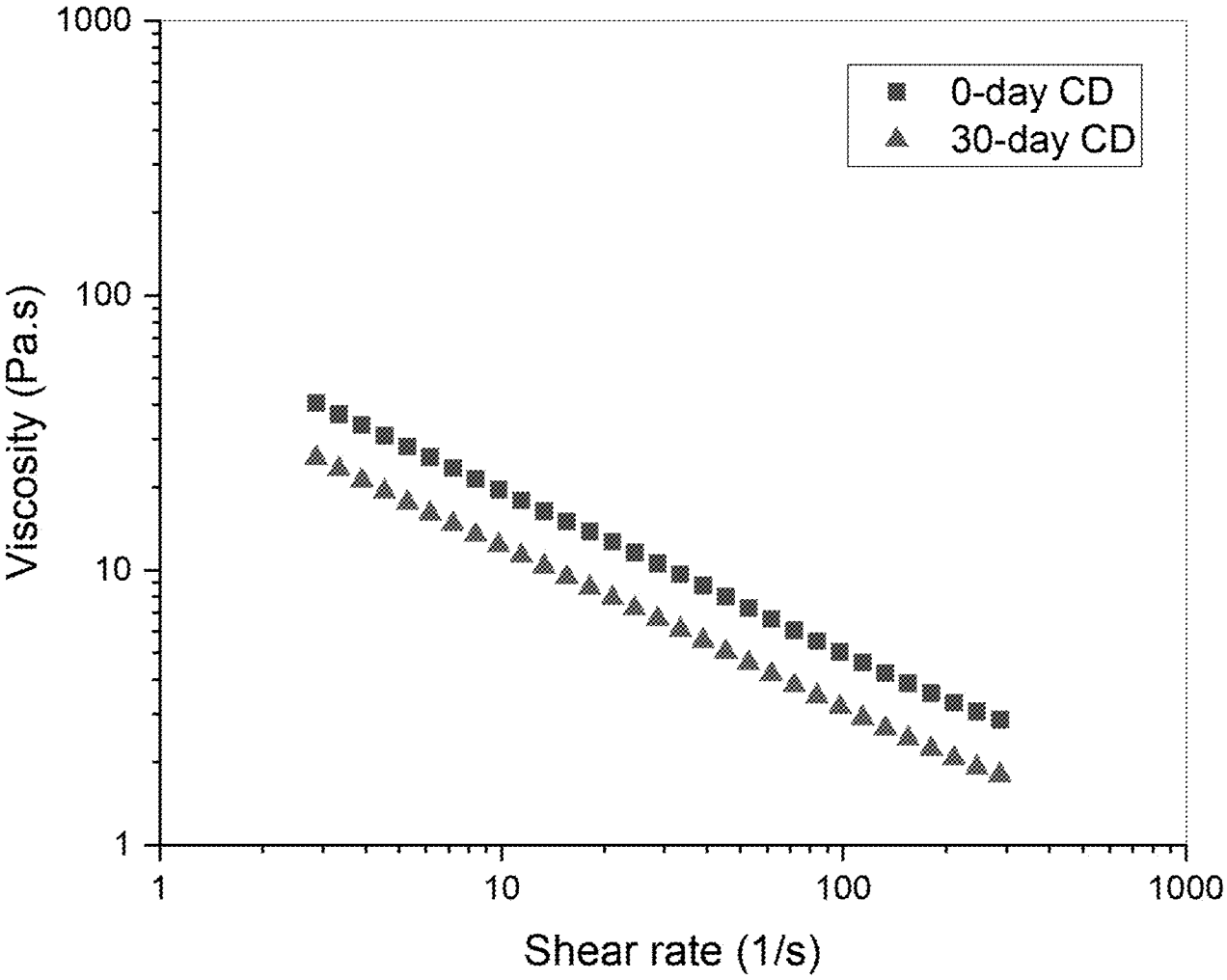
FIG. 6 shows a shear rate sweep for a 0-day dope and a 30-day dope.

The composite dopes exhibited slight differences in their shear viscosity. The 0-day dope was found to have a higher viscosity than the 30-day dope (FIG. 6). Both dopes exhibited shear-thinning behaviour. The lower viscosity dope (30-day) may be associated with the improved spinnability compared to the 0-day dope that was higher in viscosity.

Fibre Characterisation

It was possible to obtain short fibres (6-7 cm) from 0-day dope and these could be used for characterizations that require a short length of fibre (scanning electron microscopy (SEM) and TGA). For the purposes of this study, to carry out carbonisation, fibres need to be at least 13-14 cm long, as a graphite bridge with fixed length (10 cm) was used to mount the fibres.

The fibres prepared from 30-day dopes were more uniform and spun continuously. The fibres had more integrity when lifted so longer fibres (>40 cm) could be obtained. The cross-sectional area of the fibres also appeared more circular than the fibres obtained from the 0-day dope. These fibres were moved onto the next stage of the process to be thermally stabilised and then carbonised.

Tensile Testing

The mechanical properties of the 30-day fibres were tested and found to fall in the range between 200 and 400 MPa (Table 1).

TABLE 1

Tensile testing data for the carbonised 30-day fibres.

| Sample | Tensile strength [MPa] | Tensile modulus [GPa] | Diameter (um) |
|---|---|---|---|
| 1 | 220 | 28 | 61.6 |
| 2 | 159 | 19 | 60.8 |
| 3 | 171 | 20 | 60.2 |
| 4 | 394 | 43 | 50.9 |
| 5 | 371 | 44 | 50.5 |
| 6 | 235 | 36 | 56.7 |
| 7 | 93 | 15 | 63.5 |
| 8 | 118 | 20 | 61.6 |
| 9 | 262 | 33 | 58.3 |

It will be appreciated that the above description is made by way of example and not limitation of the scope of the appended claims, including any equivalents as included within the scope of the claims. Various modifications are possible and will be readily apparent to the skilled person in the art. Likewise, features of the described embodiments can be combined with any appropriate aspect described above and optional features of any one aspect can be combined with any other appropriate aspect.

The invention claimed is:

1. A method for making fibres, the method comprising:

providing a spinning dope comprising a dope solvent, lignin dissolved in the dope solvent and a carbon nanomaterial, wherein the dope solvent comprises an ionic liquid and, optionally, water; and extruding the spinning dope into a coagulant to obtain one or more fibres;

wherein the carbon nanomaterial comprises carbon nanotubes, carbon nanoribbons, graphene nanoplates or a combination thereof.

2. The method of claim 1, wherein the water content in the dope solvent is 0-30 wt %.

3. The method of claim 1, wherein the dope solvent comprises at least 1 wt % water.

4. The method of claim 1, wherein the lignin is present at a loading of at least 10%, relative to the mass of the spinning dope, excluding the mass of lignin and carbon nanomaterial.

5. The method of claim 4, wherein the lignin is present at a loading of 10-50%, relative to the mass of the spinning dope, excluding the mass of lignin and carbon nanomaterial.

6. The method of claim 1, wherein the carbon nanomaterial is present at a loading of at least 0.001%, relative to the mass of the spinning dope, excluding the mass of lignin and carbon nanomaterial.

7. The method of claim 1, wherein the carbon nanomaterial is present at a loading of 0.001-10%, relative to the mass of the spinning dope, excluding the mass of lignin and carbon nanomaterial.

8. The method of claim 1, wherein the weight ratio of lignin to carbon nanomaterial in the spinning dope is from 5:1 to 10000:1; and/or wherein the carbon nanomaterial is dispersed in the dope solvent.

9. The method of claim 1, wherein the carbon nanomaterial comprises carbon nanotubes, optionally wherein the carbon nanotubes are single-walled carbon nanotubes (SWCNTs).

10. The method of claim 1, wherein the ionic liquid comprises a cation and an anion selected from $C_{1-20}$ alkyl sulfate ($[AlkylSO_4]^-$), $C_{1-20}$ alkylsulfonate ($[AlkylSO_3]^-$), hydrogen sulfate ($[HSO_4]^-$), hydrogen sulfite ($[HSO_3]^-$), dihydrogen phosphate ($[H_2PO_4]^-$), hydrogen phosphate ($[HPO_4]^{2-}$), chloride ($Cl^-$), bromide ($Br^-$), trifluoromethanesulfonate ($[OTf]^-$), formate ($[HCOO]^-$) and acetate ($[MeCO_2]^-$), optionally wherein the anion is selected from $[HSO_4]^-$ and $[HCOO]^-$; and/or wherein the ionic liquid comprises a cation and an anion, wherein the cation contains a nitrogen-containing heterocyclic moiety or wherein the cation is a cation of Formula I

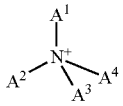

wherein $A^1$ to $A^4$ are each independently selected from H, an aliphatic, $C_{3-6}$ carbocycle, $C_{6-10}$ aryl, alkylaryl, and heteroaryl; and/or wherein the ionic liquid is an [alkylammonium]$[HSO_4]$ or [alkylammonium][HCOO] ionic liquid; and/or wherein the ionic liquid is triethylammonium hydrogen sulfate [TEA]$[HSO_4]$, N,N-dimethylbutylammonium hydrogen sulfate [DMBA]$[HSO_4]$, diethylammonium hydrogen sulfate [DEA]$[HSO_4]$, N,N-dimethylethylammonium hydrogen sulfate ([DMEA]$[HSO_4]$), diethanolammonium chloride [DEtOHA]Cl, 1-methylimidazolium hydrogen chloride [HMim]Cl, 1-ethyl-3-methylimidazolium chloride [EMim]Cl, and 1-ethyl-3-methylimidazolium trifluoromethanesulfonate [EMim][OTf], 1-butylimidazolium hydrogen sulfate ([HBim]$[HSO_4]$), methylbutylammonium hydrogen sulfate ([MBA]$[HSO_4]$), 1-methylimidazolium formate ([HMim][HCOO]), N,N-dimethylbutylammonium formate ([DMBA][HCOO]), N,N-dimethylethylammonium hydrogen sulfate ([DMEA]$[HSO_4]$), 1-butyl-3-methylimidazolium hydrogen sulfate [BMim]$[HSO_4]$, or N-dimethylbutylammonium acetate ([DMBA][OAc]), or a mixture thereof, preferably wherein the ionic liquid is [DMBA]$[HSO_4]$; and/or wherein the dope solvent further comprises ethanol, optionally wherein the ethanol is present at 1-20 wt %, relative to the total weight of dope solvent.

11. The method of claim 1, wherein the dope solvent further comprises ethanol, optionally wherein the ethanol is present at 1-20 wt %, relative to the total weight of dope solvent.

12. The method of claim 1, wherein the coagulant comprises water.

13. The method of claim 1, wherein the coagulant:

(a) comprises water and ionic liquid, wherein the ionic liquid is present at no more than 60 wt % relative to the total mass of coagulant: or (b) comprises water and sodium sulfate.

14. The method of claim 1, wherein the spinning dope is prepared by a process comprising preparing a lignin solution and combining the lignin solution with the carbon nanomaterial; wherein the lignin solution is prepared by:

a) contacting a lignocellulosic biomass comprising lignin and cellulose with a composition comprising an ionic liquid and water to dissolve the lignin and produce a cellulose pulp;

b) separating the cellulose pulp to obtain a liquor comprising the ionic liquid, water and lignin; and c) optionally adjusting the amount of ionic liquid and/or water in the liquor to obtain the lignin solution.

15. The method of claim 14, wherein the lignocellulosic biomass is contacted with the composition at 100-180 °C.

16. The method of claim 1, further comprising:

1) Drying the one or more fibres:

(a) under mechanical tension; and/or (b) by heating the one or more fibres in air, optionally at 150-300 °C; and/or 2) carbonising the one or more fibres to obtain carbon fibres, optionally wherein the carbonising comprises heating the one or more fibres to 800-3000 °C, preferably 1200-1800 °C, under an inert atmosphere.

17. A fibre obtainable by the method of claim 1.

18. A spinning dope comprising, a dope solvent, lignin and a carbon nanomaterial, wherein the dope solvent comprises an ionic liquid and optionally water.

19. A dispersion comprising carbon nanotubes and [DMBA]$[HSO_4]$.

* * * * *